US009304422B2

(12) United States Patent
Matsui et al.

(10) Patent No.: US 9,304,422 B2
(45) Date of Patent: Apr. 5, 2016

(54) MAGNETIC TONER

(71) Applicant: CANON KABUSHIKI KAISHA, Tokyo (JP)

(72) Inventors: Takashi Matsui, Mishima (JP); Michihisa Magome, Mishima (JP); Kozue Uratani, Mishima (JP); Atsuhiko Ohmori, Suntou-gun (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/571,167

(22) Filed: Dec. 15, 2014

(65) Prior Publication Data

US 2015/0185644 A1 Jul. 2, 2015

(30) Foreign Application Priority Data

Dec. 26, 2013 (JP) ..... 2013-269544

(51) Int. Cl.

| | |
|---|---|
| ***G03G 9/087*** | (2006.01) |
| ***G03G 9/083*** | (2006.01) |
| ***G03G 9/08*** | (2006.01) |
| ***G03G 9/097*** | (2006.01) |

(52) U.S. Cl.

CPC ..... *G03G 9/083* (2013.01); *G03G 9/0806* (2013.01); *G03G 9/0819* (2013.01); *G03G 9/0821* (2013.01); *G03G 9/0825* (2013.01); *G03G 9/08711* (2013.01); *G03G 9/09725* (2013.01)

(58) Field of Classification Search

CPC ..... G03G 9/09725; G03G 9/083
USPC ..... 430/108.7
See application file for complete search history.

(56) References Cited

U.S. PATENT DOCUMENTS

| | | | | |
|---|---|---|---|---|
| 6,312,861 | B1 * | 11/2001 | Ciccarelli | G03G 9/09716 430/108.3 |
| 6,465,144 | B1 | 10/2002 | Hashimoto et al. | |
| 6,638,674 | B2 | 10/2003 | Komoto et al. | |
| 6,653,035 | B2 | 11/2003 | Komoto et al. | |
| 7,935,467 | B2 | 5/2011 | Dojo et al. | |
| 8,426,094 | B2 | 4/2013 | Magome et al. | |
| 8,679,716 | B2 * | 3/2014 | Seiji | G03G 9/0821 430/108.7 |
| 8,785,095 | B2 * | 7/2014 | Yoon | G03G 9/0806 430/108.1 |
| 2003/0134217 | A1 * | 7/2003 | Combes | G03G 9/09708 430/108.11 |

(Continued)

FOREIGN PATENT DOCUMENTS

| | | |
|---|---|---|
| JP | 2008-15221 A | 1/2008 |
| JP | 2009-229785 A | 10/2009 |

*Primary Examiner* — Christopher Rodee
(74) *Attorney, Agent, or Firm* — Fitzpatrick, Cella, Harper and Scinto

(57) ABSTRACT

It is intended to provide magnetic toner that produces a stable image density in long-term use and can prevent ghosting under conditions of low-temperature and low-humidity. The present invention provides magnetic toner including magnetic toner particles each containing a binder resin, a magnetic material and a releasing agent, and silica fine particles, wherein the silica fine particles include silica fine particles A and B, the silica fine particles A have a number-average particle size of 5-20 nm as primary particles, the silica fine particles B are produced by a sol-gel method, and have a number-average particle size of 40-200 nm as primary particles, an abundance ratio of secondary particles of the silica fine particles B is 5-40% by number, and a coverage ratio X1 of the surface of the magnetic toner particles with the silica fine particles determined by ESCA is 40.0-75.0% by area.

4 Claims, 3 Drawing Sheets

(56) References Cited
U.S. PATENT DOCUMENTS

2007/0287090 A1* 12/2007 Eida ..... G03G 9/0821 430/108.7
2010/0040968 A1* 2/2010 Bejat ..... G03G 9/08711 430/108.6
2012/0251936 A1* 10/2012 Hamano ..... G03G 9/0812 430/105
2014/0335450 A1* 11/2014 Nomura ..... G03G 9/083 430/108.3

* cited by examiner

MAGNETIC TONER

BACKGROUND OF THE INVENTION

1. Field of the Invention

The present invention relates to magnetic toner for use in electrophotography, electrostatic recording, magnetic recording, etc.

2. Description of the Related Art

During the transition from analog to digital technology, printers or copying machines have been strongly required in recent years to have excellent latent image reproducibility and a high resolution as well as a compact (small) body and stable image quality in long-term use. First considering the small body, examples of approaches thereto include reduction in the sizes of constituent members of printers and fewer members constituting printers. Particularly, as for toner, examples of the approaches include compact bodies of toner receptacles such as cartridges. For the compact bodies of toner receptacles, a reduced toner consumption per page is strongly demanded. For the reduced toner consumption, it is important to develop toner in just proportion to a latent image.

A single-component contact development method is effective for improving latent image reproducibility as mentioned above. In the conventional single-component contact development method, a developer bearing member and a developer-supplying member are housed in a developing unit. This developer-supplying member can be spared to thereby achieve the reduced toner consumption as well as the more compact body of the toner receptacle.

For sparing the developer-supplying member, effectively, a magnetic field generation unit, for example, is disposed in the inside of the developer bearing member and used in combination with magnetic toner.

A challenge to such a magnetic single-component contact development method without the use of the developer-supplying member, however, is the stabilization of image quality in long-term use. Particularly, a major issue is so-called ghosts, i.e., the difference in developability between after development of a black image and after development of a white background under conditions of low temperature and low humidity (LL).

Approaches based on toner have been practiced in order to stabilize image quality in long-term use. For example, Japanese Patent Application Laid-Open No. 2008-15221 has proposed magnetic toner which specifies a ratio (B/A) of a content (B) of iron atoms to a content (A) of carbon atoms present on the surface of toner and the solubility and amount of dissolution of a magnetic material in toner during dissolution in hydrochloric acid.

Japanese Patent Application Laid-Open No. 2009-229785 has proposed toner for electrostatic latent image development, wherein a ratio $H_H/H_L$ of a saturated water content $H_H$ under conditions of high temperature and high humidity (30° C. and 95% RH) to a saturated water content $H_L$ under conditions of low temperature and low humidity (10° C. and 15% RH) is in the range of 1.50 or lower.

In any of these approaches, the toner still has the insufficient stability of image quality, albeit improved to some extent, in long-term use and thus has room for improvement, particularly, in ghosts under conditions of low temperature and low humidity.

SUMMARY OF THE INVENTION

An object of the present invention is to provide magnetic toner that can solve the problems as mentioned above. Specifically, an object of the present invention is to provide magnetic toner that produces a stable image density in long-term use and can prevent ghosting under conditions of low temperature and low humidity.

The present inventors have found that the covering state of the surface of magnetic toner particles with silica fine particles A and silica fine particles B can be controlled to thereby obtain a stable image density in long-term use and to thereby prevent ghosting under conditions of low temperature and low humidity, leading to the completion of the present invention. Specifically, the present invention is as follows:

Magnetic toner including magnetic toner particles each containing a binder resin, a magnetic material and a releasing agent, and silica fine particles present on the surface of the magnetic toner particles, wherein the silica fine particles include silica fine particles A and silica fine particles B, the silica fine particles A have a number-average particle size (D1) of 5 nm or larger and 20 nm or smaller as primary particles, the silica fine particles B are silica fine particles produced by a sol-gel method, the silica fine particles B have a number-average particle size (D1) of 40 nm or larger and 200 nm or smaller as primary particles, an abundance ratio of secondary particles of the silica fine particles B is 5% by number or more and 40% by number or less, and a coverage ratio X1 of the surface of the magnetic toner particles with the silica fine particles determined by electron spectroscopy for chemical analysis (ESCA) is 40.0% by area or more and 75.0% by area or less.

The present invention can provide magnetic toner that produces a stable image density in long-term use and can prevent ghosting under conditions of low temperature and low humidity.

Further features of the present invention will become apparent from the following description of exemplary embodiments with reference to the attached drawings.

DESCRIPTION OF THE EMBODIMENTS

Figure 1A:
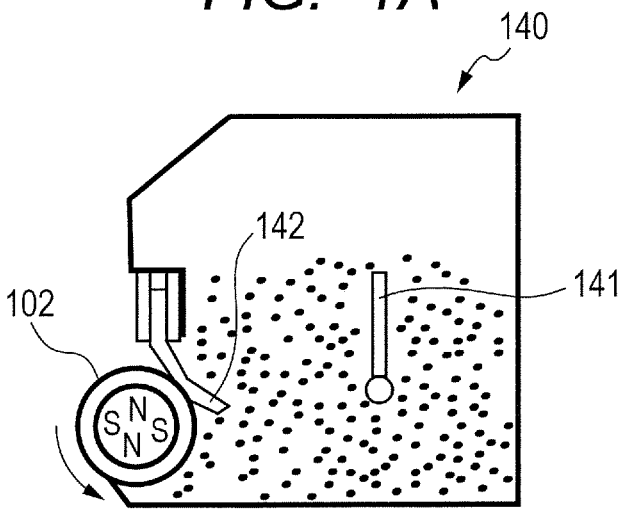
FIG. 1A is a schematic diagram illustrating one example of the configuration of a developing unit for use in the development of magnetic toner.

Preferred Embodiments of the Present Invention will now be described in detail in accordance with the accompanying drawings.

The present invention relates to magnetic toner including magnetic toner particles each containing a binder resin, a magnetic material and a releasing agent, and silica fine particles present on the surfaces of the magnetic toner particles, wherein the silica fine particles include silica fine particles A and silica fine particles B, the silica fine particles A have a number-average particle size (D1) of 5 nm or larger and 20 nm or smaller as primary particles, the silica fine particles B are produced by a sol-gel method, and have a number-average particle size (D1) of 40 nm or larger and 200 nm or smaller as primary particles, an abundance ratio of secondary particles of the silica fine particles B is 5% by number or more and 40% by number or less, and a coverage ratio X1 of the surface of the magnetic toner particles with the silica fine particles determined by electron spectroscopy for chemical analysis (ESCA) is 40.0% by area or more and 75.0% by area or less.

According to the studies of the present inventors, use of the magnetic toner as mentioned above produces a stable image density in long-term use and can prevent ghosting under conditions of low temperature and low humidity.

First, causes of ghosting will be discussed.

The ghosting refer to a phenomenon where inconsistencies in density occur in, for example, a halftone image, for example, when the amount of toner placed on a developer bearing member after development of solid white differs from the amount of toner placed on the developer bearing member after development of solid black.

Examples of cases in which the amount of toner placed on a developer bearing member after development of solid black is smaller than the desired amount include an unaffordable amount of toner supplied to the developer bearing member. Examples of causes of this unaffordable amount of toner supplied include the inability to adequately supply toner to between the developer bearing member and a regulating member, i.e., to a so-called nip of the regulating member, due to insufficient toner fluidity. Examples of a major cause of such reduction in toner fluidity include the nonuniform covering of the surface of toner particles with an external additive such as silica.

Further examples of the causes of the reduction in fluidity include the electrostatic aggregation of toner particles resulting from the frequent occurrence of frictional electrification by a stirring blade or the like in a toner receptacle under conditions of low temperature and low humidity. Further examples of the causes of the reduction in fluidity include the burying of an external additive such as silica particles into the inside of toner particles under, for example, pressing force between the developer bearing member and the regulating member in long-term use or pressing force between an image-bearing member and the developer bearing member in contact development.

On the other hand, the amount of toner placed on the developer bearing member after development of solid white may be larger than the desired amount. This phenomenon is due to the following: toner that continues to reside on the developer bearing member is susceptible to overcharging by the regulating member; thus, the toner tends to flow insufficiently at the nip of the regulating member, resulting in uneven charge among the toner particles so that the regulating member has the difficulty in regulating the amount of the toner placed. For these reasons, the amount of the toner placed becomes larger than the desired amount. In conclusion, for preventing ghosting, it is important, as mentioned above, to secure toner fluidity even under conditions of low temperature and low humidity or in long-term use and to suppress the overcharging of toner.

Accordingly, the present inventors have conducted diligent studies to improve ghosts even in long-term use under conditions of low temperature and low humidity.

As a result, the present inventors have found that the problems mentioned above can be solved by the control of the particle sizes, diffusion state and coverage ratio of silica fine particles A and silica fine particles B on the surface of the magnetic toner particles.

Hereinafter, the review by the present inventors will be given.

First, for improving toner fluidity, it is important to reduce the van der Waals force among the magnetic toner particles. The reduced van der Waals force among the magnetic toner particles can reduce the adhesion of the magnetic toner particles and can thus afford toner supply to the nip of the regulating member. In addition, the toner also has better rolling properties at the nip of the regulating member and can be uniformly charged.

As a result of conducting diligent studies, the present inventors have revealed that for reducing the van der Waals force, it is important to improve the coverage ratio with the silica fine particles A and silica fine particles B.

As a result of conducting further studies, the present inventors have revealed that fluidity can be maintained over a long period by: controlling the covering state with silica fine particles; producing the silica fine particles B by a sol-gel method; and decreasing the ratio of secondary particles of the silica fine particles B. The present inventors have also revealed that overcharging can be suppressed over a long period even under conditions of low temperature and low humidity by: producing the silica fine particles B by a sol-gel method; and decreasing the ratio of their secondary particles. Owing to these synergistic effects, the amount of toner placed on a developer bearing member after development of solid white and the amount of toner placed on the developer bearing member after development of solid black can be controlled, and the ghosts can also be overcome.

Hereinafter, the magnetic toner of the present invention will be described specifically.

In the magnetic toner of the present invention, silica fine particles A are present on the surface of the magnetic toner particles. The silica fine particles A have a number-average particle size of 5 nm or larger and 20 nm or smaller as primary particles. The presence of such silica fine particles on the surface of the toner particles tends to improve toner fluidity and can afford toner supply to the nip of the regulating member. The magnetic toner (hereinafter, also simply referred to as "toner") fluidity thus improved enables pressure to be relaxed among the toner particles even upon application of pressing force between a developer bearing member and a regulating member or pressing force between an image-bearing member and the developer bearing member in contact development. The silica fine particles can therefore be prevented from being buried in the toner particles. Thus, the toner can be prevented from deteriorating.

The silica fine particles A will be described later in detail.

In the magnetic toner of the present invention, silica fine particles B are also present on the surface of the magnetic toner particles. The silica fine particles B are silica fine particles produced by a sol-gel method and have a number-average particle size (D1) of 40 nm or larger and 200 nm or smaller as primary particles.

Since the silica fine particles B are produced by a sol-gel method, these silica fine particles have a moderate particle size and particle size distribution and are monodisperse and spherical. In addition, the silica fine particles B have lower volume resistance than that of fumed silica and are therefore less likely to be overcharged.

The surface of the magnetic toner particles (hereinafter, also simply referred to as "toner particles") is covered with these silica fine particles B in such a manner that the silica fine particles B are diffused thereon. As a result, spacer effects are exerted to improve toner fluidity. Because of their low volume resistance, the silica fine particles B can prevent the toner from being overcharged even upon frictional electrification. For exerting such effects, it is important to adjust the abundance ratio of secondary particles of the silica fine particles B to 5% by number or more and 40% by number or less. The silica fine particles B having the 40% by number or less abundance ratio of secondary particles readily exert their spacer effects and can prevent ghosts in long-term use. In addition, the toner particles tend to be uniformly covered with the silica fine particles B. Thus, the overcharging or uneven charging of the toner can be suppressed, and the ghosts can be prevented. The abundance ratio of secondary particles of the silica fine particles B can be adjusted by an apparatus for external addition of the silica fine particles B or by the adjustment of, for example, the particle size of the silica fine particles B, the order in which the silica fine particles A and the silica fine particles B are externally added, external addition intensity and external addition time.

Particularly, the order in which the silica fine particles A and the silica fine particles B are externally added is important. It is preferable that the silica fine particles B are externally added first to the toner fine particles (magnetic toner particles), and then, the silica fine particles A are externally added thereto. The external addition in this order facilitates adjusting the abundance ratio of secondary particles of the silica fine particles B and the coverage ratio with the silica fine particles. This is because the silica fine particles B are more difficult to break up than the silica fine particles A due to the influence of their shape or particle size. For this reason, the silica fine particles B externally added first to the toner fine particles are subject to shear and thus become easy to break up. By contrast, if the silica fine particles B are externally added after external addition of the silica fine particles A to the toner fine particles, the silica fine particles A already externally added to the toner fine particles increase fluidity so that the silica fine particles B are less subject to shear and thus become difficult to break up.

Sol-gel silica (silica fine particles B) will be described later in detail.

In the magnetic toner of the present invention, the coverage ratio X1 of the surface of the magnetic toner particles with the silica fine particles determined by electron spectroscopy for chemical analysis (ESCA) is 40.0% by area or more and 75.0% by area or less. When the theoretical coverage ratio with the silica fine particles is defined as X2, a diffusion index represented by the following Expression 1 satisfies the following Expression 2:

$$\text{Diffusion index}=X1/X2 \qquad \text{(Expression 1)}$$

$$\text{Diffusion index}\geq -0.0042\times X1+0.62 \qquad \text{(Expression 2)}$$

The coverage ratio X1 can be calculated from the ratio of the detection intensity of Si atoms measured in the toner to the detection intensity of Si atoms measured in the silica fine particles alone by ESCA. This coverage ratio X1 represents the proportion of an area actually covered with the silica fine particles to the whole surface of the toner particles.

The coverage ratio X1 of 40.0% by area or more and 75.0% by area or less facilitates reducing the adhesion among the toner particles or the adhesion of the toner to a member. This tends to improve toner fluidity and can afford toner supply to the nip of the regulating member. The toner fluidity thus improved enables pressure to be relaxed among the toner particles even upon application of pressing force between a developer bearing member and a regulating member or pressing force between an image-bearing member and the developer bearing member in contact development. The silica fine particles can therefore be prevented from being buried in the toner particles. Thus, the toner can be prevented from deteriorating.

On the other hand, the theoretical coverage ratio X2 with the silica fine particles is calculated according to Expression 4 given below using, for example, the number of parts by mass of the silica fine particles with respect to 100 parts by mass of the toner particles, and the particle size of the silica fine particles. This coverage ratio X2 represents the proportion of a theoretically coverable area to the surface of the toner particles.

$$\text{Theoretical coverage ratio } X2(\%\text{ by area})=3^{1/2}/(2\pi)\times(dt/da)\times(\rho t/\rho a)\times C\times 100 \qquad \text{(Expression 4)}$$

da: number-average particle size (D1) of the silica fine particles dt: weight-average particle size (D4) of the toner particles ρa: true specific gravity of the silica fine particles ρt: true specific gravity of the toner C: mass of the silica fine particles/mass of the toner (=the number of parts of the silica fine particles added (part by mass) with respect to 100 parts by mass of the toner particles/(the number of parts of the silica fine particles added (part by mass) with respect to 100 parts by mass of the toner particles+100 (parts by mass)))

If the amount of the silica fine particles added is unknown, "C" is used based on a method for measuring the "content of the silica fine particles in the toner" mentioned later. Hereinafter, the physical implications of the diffusion index represented by Expression 1 will be described.

The diffusion index represents a divergence between the actually measured coverage ratio X1 and the theoretical coverage ratio X2. The degree of this divergence is considered to indicate the amount of silica fine particles multilayered (e.g., 2-layered or 3-layered) in the vertical direction on the surface of the toner particles. Ideally, the diffusion index is 1. In this case, however, the coverage ratio X1 is equal to the theoretical coverage ratio X2. This means that the multilayered (2- or more layered) silica fine particles are absent. By contrast, when aggregates of the silica fine particles are present on the surface of the toner particles, the divergence occurs between the actually measured coverage ratio and the theoretical coverage ratio, resulting in a low diffusion index. In short, the diffusion index can be interchanged with an index for the amount of the silica fine particles present as aggregates.

It is important for the diffusion index according to the present invention to fall within the range represented by Expression 2. This range seems to be larger than that of toner produced by a conventional technique. The larger diffusion index indicates that the silica fine particles on the surface of the toner particles are present as a smaller amount of aggregates and as a larger amount of primary particles. As mentioned above, the upper limit of the diffusion index is 1.

The boundary line of the diffusion index according to the present invention is a function of the variable coverage ratio X1 in the range of 40.0% by area or more and 75.0% by area or less. The calculation of this function is obtained empirically from the ease of breakup of the toner when the coverage ratio X1 and the diffusion index are determined with the silica fine particles, external addition conditions, etc. varied.

Figure 2:
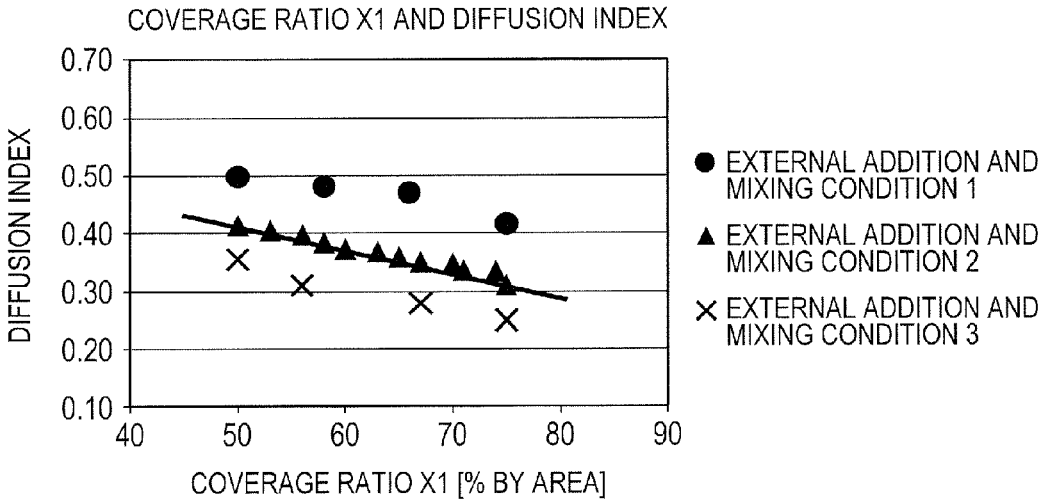
FIG. 2 is a diagram illustrating the boundary line of a diffusion index.

FIG. 2 is a graph for a plot of the relationship between the coverage ratio X1 and the diffusion index of each produced toner having a coverage ratio X1 arbitrarily changed using 3 types of external addition and mixing conditions and the silica fine particles added in varying amounts. Of the toner samples plotted on this graph, a toner plotted in an area that satisfies Expression 2 has been found to be sufficiently improved in terms of the ease of breakup during application of pressure.

Although the detailed reason why the diffusion index depends on the coverage ratio X1 is unknown, the present inventors have made the following prediction: the amount of the silica fine particles present as secondary particles is, desirably, small, but is also influenced in no small part by the coverage ratio X1. With increase in the coverage ratio X1, the toner gradually becomes easier to break up. The acceptable amount of the silica fine particles present as secondary particles is therefore increased. In this way, the boundary line of the diffusion index is considered to be a function of the variable coverage ratio X1.

In short, it has been empirically found that: the coverage ratio X1 and the diffusion index have the correlation therebetween; and it is important to control the diffusion index according to the coverage ratio X1.

When the diffusion index falls within a range represented by Expression 5 given below, a larger amount of the silica fine particles is present as aggregates. The resultant toner is less likely to be prevented from deteriorating. In addition, the adhesion among the toner particles or the adhesion of the toner to a member is difficult to reduce. Thus, the effects intended by the present invention cannot be sufficiently exerted.

$$\text{Diffusion index} < -0.0042 \times X1 + 0.62 \quad \text{(Expression 5)}$$

The total energy of the toner used in the present invention can preferably be 280 mJ/(g/mL) or higher and 355 mJ/(g/mL) or lower.

Since the toner used in the present invention is easy-to-break up toner as mentioned above, the toner is favorably exchangeable in a regulating member and can have more chance of being charged.

The total energy refers to a physical property value that indicates stress required to break up the toner in a consolidated state after consolidation of the toner by the application of pressure, and serves as an index for ease of breakup from the consolidated state in the regulating member. The toner having the total energy of 355 mJ/(g/mL) or lower is easy to break up and can be favorably exchangeable on a toner bearing member (developer bearing member). On the other hand, toner having a total energy smaller than 280 mJ/(g/mL) is not favorable because image defects often occur.

This is because for facilitating breaking up the toner, it is required to add, for example, a large amount of an external additive or to add a large amount of silica fine particles produced by a sol-gel method. In such a case, the presence of a large amount of the external additive may fail to offer the desired electrostatic properties, resulting in fogging. In addition, the external additive tends to be deposited onto the toner-regulating member to trigger the occurrence of streaks on the resulting image.

For the toner used in the present invention, the isolation rate of the silica fine particles can be 30% or less. The isolation rate of the silica fine particles can be adjusted by, for example, an apparatus for use in external addition, external addition intensity and external addition time. The toner having the 30% or less isolation rate of the silica fine particles tends to be uniformly charged and prevented from fogging. In addition, variations in toner fluidity in long-term use can be suppressed. The improved stability of image quality in long-term use can therefore be easily obtained.

Next, each component contained in the magnetic toner of the present invention will be described. The magnetic toner of the present invention is magnetic toner having magnetic toner particles containing a binder resin, a magnetic material and a releasing agent, and silica fine particles present on the surface of the magnetic toner particles. The silica fine particles include silica fine particles A and silica fine particles B. The magnetic toner of the present invention may further contain other components such as a charge control agent, if necessary.

Hereinafter, each of these components contained in the magnetic toner of the present invention will be described sequentially in detail.

<Magnetic Material>

First, the magnetic material will be described.

The magnetic material used in the toner of the present invention is composed mainly of a magnetic iron oxide such as ferrosoferric oxide or γ-ferric oxide and may contain an element such as phosphorus, cobalt, nickel, copper, magnesium, manganese, aluminum or silicon. The BET specific surface area of the magnetic material measured by a nitrogen adsorption method is preferably 2 to 30 $m^2/g$, more preferably 3 to 28 $m^2/g$. Also, the Mohs hardness of the magnetic material can be 5 to 7. The magnetic material has a shape such as a polyhedral, octahedral, hexahedral, spherical, needle-like or scale-like shape. Among these magnetic materials, a less anisotropic magnetic material (e.g., polyhedral, octahedral, hexahedral or spherical material) is preferred for enhancing an image density.

The volume-average particle size of the magnetic material can be 0.10 μm or larger and 0.40 μm or smaller. The magnetic material having the volume-average particle size of 0.10 μm or larger is less likely to be aggregated and thus has better uniform dispersibility in the toner. The magnetic material having the volume-average particle size of 0.40 μm or smaller can improve the coloring power of the toner.

In this context, the volume-average particle size of the magnetic material can be measured using a transmission electron microscope. Specifically, the toner particles to be observed are thoroughly dispersed in an epoxy resin, which are then cured for 2 days in an atmosphere having a temperature of 40° C. to obtain a cured resin. The obtained cured resin is sliced using a microtome, and the resulting samples are photographed under a transmission electron microscope (TEM) at a magnification of ×10,000 to 40,000 to measure the diameters of 100 magnetic material particles in the field of view. Then, the volume-average particle size is calculated based on a circle-equivalent diameter equal to the projected area of the magnetic material. Alternatively, the particle size may be measured using an image analysis apparatus.

The magnetic material used in the toner of the present invention can be produced by, for example, the following method: to an aqueous ferrous salt solution, an alkali such as sodium hydroxide is added at an equivalent or more with respect to the iron component to prepare an aqueous solution containing ferrous hydroxide. Air is blown into the prepared aqueous solution with its pH kept at 7 or higher. While the aqueous solution is heated to 70° C. or higher, the oxidation reaction of ferrous hydroxide is performed to initially form seed crystals serving as the core of a magnetic iron oxide powder.

Next, an aqueous solution containing 1 equivalent of ferrous sulfate based on the amount of the alkali added beforehand is added to the slurry solution containing the seed crystals. While air is blown into the resulting solution with its pH kept at 5 to 10, the reaction of ferrous hydroxide is allowed to proceed to grow a magnetic iron oxide powder with the seed crystals as the core. In this procedure, pH, reaction temperature and stirring conditions can be arbitrarily selected to thereby control the shape and magnetic properties of the magnetic material. As the oxidation reaction proceeds, the pH of the solution is shifted to an acidic region. The pH of the solution, however, should not be lower than 5. The magnetic material thus obtained can be filtered, washed and dried by routine methods to obtain a magnetic material.

For the production of the toner according to the present invention by a polymerization method, the surface of the magnetic material is particularly preferably subjected to hydrophobization treatment. In the case of performing the surface treatment by a dry process, the washed, filtered and dried magnetic material is treated with a coupling agent. In the case of performing the surface treatment by a wet process, the reaction product dried after the completion of the oxidation reaction is redispersed, or the iron oxide form obtained by washing and filtration after the completion of the oxidation reaction is redispersed in a fresh aqueous medium for coupling treatment without being dried.

Specifically, a silane coupling agent is added to the redispersion with sufficient stirring. After hydrolysis, the temperature is raised or the pH of the dispersion is adjusted to an alkaline region to perform coupling treatment. Among these approaches, the approach of performing filtration and washing after the completion of the oxidation reaction and then subjecting the resulting slurry to surface treatment without drying is preferred from the viewpoint of performing uniform surface treatment.

For the surface treatment of the magnetic material by a wet process, i.e., the treatment of the magnetic material with a coupling agent in an aqueous medium, first, the magnetic material is thoroughly dispersed in the aqueous medium until a primary particle size is achieved. This dispersion is stirred using a stirring blade or the like so as not to precipitate or aggregate the dispersion. Subsequently, an arbitrary amount of a coupling agent is added to the dispersion. While the coupling agent is hydrolyzed, surface treatment is performed. This surface treatment is also more preferably performed while the magnetic material is thoroughly dispersed with stirring using an apparatus such as a pin mill or a line mill so as not to aggregate the dispersion.

In this context, the aqueous medium refers to a medium composed mainly of water. Specific examples thereof include water itself, water supplemented with a small amount of a surfactant, water supplemented with a pH adjuster and water supplemented with an organic solvent. The surfactant can be a nonionic surfactant such as polyvinyl alcohol. The surfactant can be added in an amount of 0.1 to 5.0% by mass to water. Examples of the pH adjuster include inorganic acids such as hydrochloric acid. Examples of the organic solvent include alcohols.

Examples of the coupling agent that can be used in the surface treatment of the magnetic material according to the present invention include silane coupling agents and titanium coupling agents. Among these coupling agents, a silane coupling agent represented by the general formula (1) is more preferably used:

$$R_mSiY_n \qquad \text{General formula (1)}$$

wherein R represents an alkoxy group; m represents an integer of 1 to 3; Y represents a functional group such as an alkyl group, a vinyl group, an epoxy group, an acryl group or a methacryl group; and n represents an integer of 1 to 3, provided that m+n=4.

Examples of the silane coupling agent represented by the general formula (1) can include vinyltrimethoxysilane, vinyltriethoxysilane, vinyltris(β-methoxyethoxy)silane, β-(3,4-epoxycyclohexyl)ethyltrimethoxysilane, γ-glycidoxypropyltrimethoxysilane, γ-glycidoxypropylmethyldiethoxysilane, γ-aminopropyltriethoxysilane, N-phenyl-γ-aminopropyltrimethoxysilane, γ-methacryloxypropyltrimethoxysilane, vinyltriacetoxysilane, methyltrimethoxysilane, dimethyldimethoxysilane, phenyltrimethoxysilane, diphenyldimethoxysilane, methyltriethoxysilane, dimethyldiethoxysilane, phenyltriethoxysilane, diphenyldiethoxysilane, n-butyltrimethoxysilane, isobutyltrimethoxysilane, trimethylmethoxysilane, n-hexyltrimethoxysilane, n-octyltrimethoxysilane, n-octyltriethoxysilane, n-decyltrimethoxysilane, hydroxypropyltrimethoxysilane, n-hexadecyltrimethoxysilane and n-octadecyltrimethoxysilane.

Among these silane coupling agents, an alkyltrialkoxysilane coupling agent represented by the following general formula (2) is preferably used from the viewpoint of imparting high hydrophobicity to the magnetic material:

$$C_pH_{2p+1}—Si—(OC_qH_{2q+1})_3 \qquad \text{General formula (2)}$$

wherein p represents an integer of 2 to 20, and q represents an integer of 1 to 3. An alkyltrialkoxysilane coupling agent represented by the general formula (2) wherein p is smaller than 2 has the difficulty in imparting adequate hydrophobicity to the magnetic material. Alternatively, an alkyltrialkoxysilane coupling agent represented by the general formula (2) wherein p is larger than 20 is not favorable because the magnetic material particles are more frequently combined, though this coupling agent can confer adequate hydrophobicity. A silane coupling agent wherein q is larger than 3 is less capable of sufficient hydrophobization due to reduced reactivity. For these reasons, the alkyltrialkoxysilane coupling agent represented by the formula wherein p represents an integer of 2 to 20 (more preferably an integer of 3 to 15), and q represents an integer of 1 to 3 (more preferably an integer of 1 or 2) is preferably used.

In the case of using these silane coupling agents, each silane coupling agent may be used alone in the treatment, or plural types thereof may be used in combination in the treatment. For the combined use of the plural types, the treatment may be performed using each coupling agent individually or using the coupling agents simultaneously.

The total amount of the coupling agent used in the treatment can be 0.9 to 3.0 parts by mass with respect to 100 parts by mass of the magnetic material. It is important to adjust the amount of the treatment agent according to the surface area of the magnetic material, the reactivity of the coupling agent, etc.

In the present invention, the magnetic material may be used in combination with an additional colorant. Examples of the colorant that may be used in combination therewith include dyes and pigments known in the art as well as magnetic or nonmagnetic inorganic compounds. Specific examples thereof include ferromagnetic metal particles such as cobalt and nickel and their alloys with chromium, manganese, copper, zinc, aluminum, rare-earth elements, etc., particles such as hematite, titanium black, nigrosine dyes/pigments, carbon black and phthalocyanine. These colorants can also be used after being surface-treated.

<Binder Resin>

Next, the binder resin will be described.

The binder resin in the magnetic toner of the present invention can be a styrene resin.

Specific examples of the styrene resin include polystyrene and styrene copolymers such as styrene-propylene copolymers, styrene-vinyltoluene copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butyl methacrylate copolymers, styrene-octyl methacrylate copolymers, styrene-butadiene copolymers, styrene-isoprene copolymers, styrene-maleic acid copolymers and styrene-maleic acid ester copolymers. These styrene resins can be used alone or in combination.

Among these styrene resins, a styrene-butyl acrylate copolymer or a styrene-butyl methacrylate copolymer is preferred because the degree of branching or resin viscosity can be easily adjusted; thus developability can be easily maintained over a long period.

The binder resin used in the magnetic toner of the present invention can be a styrene resin, which may be used in combination with any of resins mentioned below without impairing the effects of the present invention.

For example, polymethyl methacrylate, polybutyl methacrylate, polyvinyl acetate, polyethylene, polypropylene, polyvinylbutyral, silicone resins, polyester resins, polyamide resins, epoxy resins and polyacrylic acid resins can be used. These resins can be used alone or in combination.

Examples of monomers for the formation of the styrene resin include: styrene; styrene derivatives such as o-methylstyrene, m-methylstyrene, p-methylstyrene, p-methoxystyrene, p-phenylstyrene, p-chlorostyrene, 3,4-dichlorostyrene, p-ethylstyrene, 2,4-dimethylstyrene, p-n-butylstyrene, p-tert-butylstyrene, p-n-hexylstyrene, p-n-octylstyrene, p-n-nonylstyrene, p-n-decylstyrene and p-n-dodecylstyrene; unsaturated monoolefins such as ethylene, propylene, butylene and isobutylene; unsaturated polyenes such as butadiene and isoprene; vinyl halides such as vinyl chloride, vinylidene chloride, vinyl bromide and vinyl fluoride; vinyl esters such as vinyl acetate, vinyl propionate and vinyl benzoate; α-methylene aliphatic monocarboxylic acid esters such as methyl methacrylate, ethyl methacrylate, propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate and diethylaminoethyl methacrylate; acrylic acid esters such as methyl acrylate, ethyl acrylate, n-butyl acrylate, isobutyl acrylate, propyl acrylate, n-octyl acrylate, dodecyl acrylate, 2-ethylhexyl acrylate, stearyl acrylate, 2-chloroethyl acrylate and phenyl acrylate; vinyl ethers such as vinyl methyl ether, vinyl ethyl ether and vinyl isobutyl ether; vinyl ketones such as vinyl methyl ketone, vinyl hexyl ketone and methyl isopropenyl ketone; N-vinyl compounds such as N-vinylpyrrole, N-vinylcarbazole, N-vinylindole and N-vinylpyrrolidone; vinylnaphthalenes; and acrylic acid or methacrylic acid derivatives such as acrylonitrile, methacrylonitrile and acrylamide.

Further examples thereof include: unsaturated dibasic acids such as maleic acid, citraconic acid, itaconic acid, alkenylsuccinic acid, fumaric acid and mesaconic acid; unsaturated dibasic anhydrides such as maleic anhydride, citraconic anhydride, itaconic anhydride and alkenylsuccinic anhydride; unsaturated dibasic acid half esters such as maleic acid methyl half ester, maleic acid ethyl half ester, maleic acid butyl half ester, citraconic acid methyl half ester, citraconic acid ethyl half ester, citraconic acid butyl half ester, itaconic acid methyl half ester, alkenylsuccinic acid methyl half ester, fumaric acid methyl half ester and mesaconic acid methyl half ester; unsaturated dibasic acid esters such as dimethyl maleate and dimethyl fumarate; α,β-unsaturated acids such as acrylic acid, methacrylic acid, crotonic acid and cinnamic acid; α,β-unsaturated acid anhydrides such as crotonic anhydride and cinnamic anhydride, and anhydrides of the α,β-unsaturated acids and lower fatty acids; and monomers having a carboxyl group, such as alkenylmalonic acid, alkenylglutaric acid, alkenyladipic acid, their acid anhydrides, and their monoesters.

Further examples thereof include: acrylic acid or methacrylic acid esters such as 2-hydroxyethyl acrylate, 2-hydroxyethyl methacrylate and 2-hydroxypropyl methacrylate; and monomers having a hydroxy group, such as 4-(1-hydroxy-1-methylbutyl)styrene and 4-(1-hydroxy-1-methylhexyl)styrene.

The styrene resin that can be used as the binder resin in the magnetic toner of the present invention may have a structure cross-linked using a cross-linking agent having two or more vinyl groups. In this case, examples of the cross-linking agent used include: Aromatic divinyl compounds, for example, divinylbenzene and divinylnaphthalene.

Diacrylate compounds having an alkyl chain bridge, for example, ethylene glycol diacrylate, 1,3-butylene glycol diacrylate, 1,4-butanediol diacrylate, 1,5-pentanediol acrylate, 1,6-hexanediol diacrylate, neopentyl glycol diacrylate, and these compounds with acrylate replaced with methacrylate.

Diacrylate compounds having an alkyl chain bridge containing an ether bond, for example, diethylene glycol diacrylate, triethylene glycol diacrylate, tetraethylene glycol diacrylate, polyethylene glycol #400 diacrylate, polyethylene glycol #600 diacrylate, dipropylene glycol diacrylate, and these compounds with acrylate replaced with methacrylate.

Diacrylate compounds having a bridge of a chain containing an aromatic group and an ether bond, for example, polyoxyethylene (2)-2,2-bis(4-hydroxyphenyl)propane diacrylate, polyoxyethylene (4)-2,2-bis(4-hydroxyphenyl)propane diacrylate, and these compounds with acrylate replaced with methacrylate.

Polyester-type diacrylate compounds, for example, MANDA (trade name; Nippon Kayaku Co., Ltd.).

Examples of polyfunctional cross-linking agents include: pentaerythritol triacrylate, trimethylolethane triacrylate, trimethylolpropane triacrylate, tetramethylolmethane tetraacrylate, oligoester acrylate, and these compounds with acrylate replaced with methacrylate; and triallyl cyanurate and triallyl trimellitate.

The amount of the cross-linking agent used is preferably 0.01 to 10 parts by mass, more preferably 0.03 to 5 parts by mass, with respect to 100 parts by mass of other monomer components.

Among these cross-linking agents, examples of cross-linking agents that can be used for improving durability include aromatic divinyl compounds (particularly, divinylbenzene) and diacrylate compounds having a bridge of a chain containing an aromatic group and an ether bond.

The glass transition temperature (Tg) of the binder resin according to the present invention can be 45° C. to 70° C. The binder resin having Tg of 45° C. or higher tends to improve long-term developability. The binder resin having Tg of 70° C. or lower tends to render low-temperature fixability better.

<Releasing Agent>

The magnetic toner of the present invention contains a releasing agent.

Examples of the releasing agent include: waxes composed mainly of fatty acid esters, such as carnauba wax and montanic acid ester wax; waxes composed mainly of fatty acid esters with acid components partially or totally deoxidized, such as deoxidized carnauba wax; hydroxyl group-containing methyl ester compounds obtained by the hydrogenation or the like of vegetable oils; saturated fatty acid monoesters such as stearyl stearate and behenyl behenate; diesterification products of saturated aliphatic dicarboxylic acids and saturated aliphatic alcohols, such as dibehenyl sebacate, distearyl dodecanedioate and distearyl octadecanedioate; diesterification products of saturated aliphatic diols and saturated fatty acids, such as nonanediol dibehenate and dodecanediol distearate; aliphatic hydrocarbon waxes such as low-molecular-weight polyethylene, low-molecular-weight polypropylene, microcrystalline wax, paraffin wax and Fischer-Tropsch wax; oxides of aliphatic hydrocarbon waxes such as polyethylene oxide wax, and their block copolymers; waxes obtained by the grafting of aliphatic hydrocarbon waxes using vinyl monomers of styrene, acrylic acid, or the like; saturated straight-chain fatty acids such as palmitic acid, stearic acid and montanic acid; unsaturated fatty acids such as brassidic acid, eleostearic acid and parinaric acid; saturated alcohols such as stearyl alcohol, aralkyl alcohol, behenyl alcohol, carnaubyl alcohol, seryl alcohol and melissyl alcohol; polyhydric alcohols such as sorbitol; fatty acid amides such as linoleamide, oleamide and lauramide; saturated fatty acid bisamides such as methylene bis-stearamide, ethylene bis-capramide, ethylene bis-lauramide and hexamethylene bis-stearamide; unsaturated fatty acid amides such as ethylene bis-oleamide, hexamethylene bis-oleamide, N,N'-dioleyladipamide and N,N'-dioleylsebacamide; aromatic bisamides such as m-xylene bis-stearamide and N,N'-distearylisophthalamide; aliphatic metal salts (which are generally called metallic soaps) such as calcium stearate, calcium laurate, zinc stearate and magnesium stearate; and long-chain alkyl alcohols or long-chain alkylcarboxylic acids having 12 or more carbon atoms.

Among these releasing agents, a monofunctional or bifunctional ester wax (e.g., saturated fatty acid monoesters and diesterification products) or a hydrocarbon wax (e.g., paraffin wax and Fischer-Tropsch wax) is preferred.

The melting point of the releasing agent defined by the temperature at the maximum endothermic peak during heating measured using a differential scanning calorimeter (DSC) is preferably 60 to 140° C., more preferably 60 to 90° C. The releasing agent having the melting point of 60° C. or higher can improve the preservative quality of the magnetic toner of the present invention. On the other hand, the releasing agent having the melting point of 140° C. or lower can easily improve low-temperature fixability.

The content of the releasing agent can be 3 to 30 parts by mass with respect to 100 parts by mass of the binder resin. The releasing agent having the content of 3 parts by mass or larger tends to render fixability better. On the other hand, the magnetic toner containing the releasing agent at the content of 30 parts by mass or smaller is less likely to deteriorate in long-term use and tends to have better image stability.

The magnetic toner of the present invention may further contain a charge control agent. In this context, the magnetic toner of the present invention can be negatively charged toner.

The charge control agent for negative charging is, effectively, an organic metal complex compound or a chelate compound. Examples thereof include: monoazo metal complex compounds; acetylacetone metal complex compounds; and metal complex compounds of aromatic hydroxycarboxylic acids or aromatic dicarboxylic acids.

Specific examples of commercially available products include Spilon Black TRH, T-77 and T-95 (Hodogaya Chemical Co., Ltd.), and BONTRON® S-34, S-44, S-54, E-84, E-88 and E-89 (Orient Chemical Industries Co., Ltd.).

These charge control agents can be used alone or in combination. The amount of the charge control agent used is preferably 0.1 to 10.0 parts by mass, more preferably 0.1 to 5.0 parts by mass, with respect to 100 parts by mass of the binder resin in terms of the charge of the magnetic toner.

<Silica Fine Particles>

As mentioned above, the silica fine particles present on the surface of the magnetic toner particles include silica fine particles A and silica fine particles B. In this context, the total amount of the silica fine particles including silica fine particles A and silica fine particles B can be 0.6 parts by mass or larger and 2.0 parts by mass or smaller with respect to 100 parts by mass of the magnetic toner particles.

<Silica Fine Particles A>

Next, the silica fine particles A present on the surface of the magnetic toner particles will be described.

The silica fine particles A refer to fine particles formed by the vapor-phase oxidation of a silicon-halogen compound, and fine particle called silica produced by a dry process or fumed silica can be used. For example, the silica fine particles are produced through the thermal decomposition and oxidation reactions of silicon tetrachloride gas in oxygen and hydrogen, which is based on the following reaction scheme:

$$SiCl_4+2H_2+O_2 \rightarrow SiO_2+4HCl$$

In this production process, the silicon-halogen compound can also be used together with another metal halogen compound, for example, aluminum chloride or titanium chloride to obtain composite fine particles of silica and an additional metal oxide. Such composite fine particles are also included in the silica fine particles A according to the present invention.

<Number-Average Particle Size (D1) of Silica Fine Particles a as Primary Particles>

The number-average particle size (D1) of the silica fine particles A according to the present invention as primary particles is 5 nm or larger and 20 nm or smaller.

The silica fine particles A having a particle size within the range mentioned above can easily control the coverage ratio X1 and the diffusion index.

In the present invention, the number-average particle size (D1) of the silica fine particles A as primary particles is measured by a method of magnifying and observing the state of the silica fine particles alone under a scanning electron microscope before external addition to the toner particles or magnifying and observing the surface of the toner particles after external addition to the toner particles. In this respect, the particle sizes of at least 300 silica fine particles are measured and averaged to obtain the number-average particle size (D1) of the primary particles. Detailed conditions for the measurement will be mentioned later.

The silica fine particles formed by the vapor-phase oxidation of the silicon-halogen compound are more preferably hydrophobically surface-treated silica fine particles. The treated silica fine particles are particularly preferably silica fine particles treated such that its degree of hydrophobization measured by a methanol titration test exhibits a value in the range of 30 to 80.

Examples of methods for the hydrophobization treatment include a method of chemically treating the silica fine particles with an organic silicon compound and/or silicone oil capable of reacting with or being physically adsorbed on the silica fine particles, preferably, a method of chemically treating the silica fine particles formed by the vapor-phase oxidation of the silicon-halogen compound, with an organic silicon compound.

Examples of the organic silicon compound include hexamethyldisilazane, trimethylsilane, trimethylchlorosilane, trimethylethoxysilane, dimethyldichlorosilane, methyltrichlorosilane, allyldimethylchlorosilane, allylphenyldichlorosilane, benzyldimethylchlorosilane, bromomethyldimethylchlorosilane, α-chloroethyltrichlorosilane, β-chloroethyltrichlorosilane, chloromethyldimethylchlorosilane, triorganosilylmercaptan, trimethylsilylmercaptan, triorganosilyl acrylate, vinyldimethylacetoxysilane, dimethylethoxysilane, dimethyldimethoxysilane, diphenyldiethoxysilane, hexamethyldisiloxane, 1,3-divinyltetramethyldisiloxane, 1,3-diphenyltetramethyldisiloxane and dimethylpolysiloxane having 2 to 12 siloxane units per molecule and having one hydroxy group at Si of each terminal unit. These organic silicon compounds are used singly or as a mixture.

Alternatively, a silane coupling agent having a nitrogen atom, such as aminopropyltrimethoxysilane, aminopropyltriethoxysilane, dimethylaminopropyltrimethoxysilane, diethylaminopropyltrimethoxysilane, dipropylaminopropyltrimethoxysilane, dibutylaminopropyltrimethoxysilane, monobutylaminopropyltrimethoxysilane, dioctylaminopropyldimethoxysilane, dibutylaminopropyldimethoxysilane, dibutylaminopropylmonomethoxysilane, dimethylaminophenyltriethoxysilane, trimethoxysilyl-γ-propylphenylamine or trimethoxysilyl-γ-propylbenzylamine may be used alone or in combination therewith. Preferred examples of the silane coupling agent include hexamethyldisilazane (HMDS).

The kinematic viscosity of the silicone oil at 25° C. is preferably 0.5 to 10000 $mm^2/s$, more preferably 1 to 1000 $mm^2/s$, further preferably 10 to 200 $mm^2/s$. Specific examples thereof include dimethylsilicone oil, methylphenylsilicone oil, α-methylstyrene-modified silicone oil, chlorophenylsilicone oil and fluorine-modified silicone oil.

Examples of methods for the silicone oil treatment include: a method of directly mixing the silica fine particles treated with a silane coupling agent with the silicone oil using a mixing machine such as a Henschel mixer; a method of spraying the silicone oil onto the silica fine particles as a base; and a method of dissolving or dispersing the silicone oil in an appropriate solvent, then adding and mixing the silica fine particles to the solution or dispersion, and removing the solvent.

The silica of the silica fine particles thus treated with the silicone oil is more preferably heated to 200° C. or higher (more preferably 250° C. or higher) in an inert gas to stabilize the surface coat.

The amount of the silicone oil used in the treatment is 1 parts by mass to 40 parts by mass, preferably 3 parts by mass to 35 parts by mass, with respect to 100 parts by mass of the silica fine particles, from the viewpoint of easily obtaining favorable hydrophobicity.

The specific surface area (measured by a BET nitrogen adsorption method) of the silica fine particles (silica bulk) before the hydrophobization treatment can be 200 $m^2/g$ or larger and 350 $m^2/g$ or smaller for imparting favorable fluidity to the toner.

The measurement of the specific surface area by the BET nitrogen adsorption method is performed according to JIS 28830 (2001). An "automatic specific surface area/pore distribution measurement apparatus TriStar 3000 (manufactured by Shimadzu Corp.)", which adopts a gas adsorption method based on a constant-volume method for measurement, is used as a measurement apparatus.

The apparent density of the silica fine particles A used in the present invention can be 15 g/L or larger and 50 g/L smaller. The apparent density of the silica fine particles A in the range mentioned above means that the silica fine particles A are less likely to be densely packed and are present with a large amount of air between the fine particles, and indicates a very low apparent density. In the toner as well, the toner particles are therefore less likely to be densely packed and thus tend to have low adhesion therebetween.

Examples of units for controlling the apparent density of the silica fine particles A in the range mentioned above include the adjustment of the particle size of the silica bulk used in the silica fine particles, the adjustment of the intensity of cracking treatment performed before, after, or during the hydrophobization treatment, and the adjustment of the amount of the silicone oil used in the treatment. The particle size of the silica bulk can be reduced to thereby increase the BET specific surface area of the obtained silica fine particles, between which a large amount of air can in turn be present. The apparent density can therefore be reduced. In addition, the cracking treatment can break up relatively large aggregates contained in the silica fine particles into relatively small secondary particles, and can thus reduce the apparent density.

In this context, the amount of the silica fine particles A added can be 0.5 parts by mass or larger and 1.5 parts by mass or smaller with respect to 100 parts by mass of the magnetic toner particles. The silica fine particles A added in an amount in the range mentioned above tend to properly control the coverage ratio and the diffusion index.

<Silica Fine Particles B>

Next, the silica fine particles B present on the surface of the magnetic toner particles will be described. The silica fine particles B are silica fine particles produced by a sol-gel method. The sol-gel method refers to a method which involves subjecting alkoxysilane to hydrolysis and condensation reactions with a catalyst in an organic solvent containing water, and removing the solvent from the obtained silica sol suspension, followed by drying to prepare particles. The silica fine particles obtained by this sol-gel method have a moderate particle size and particle size distribution and are monodisperse and spherical. These particles are therefore easy to disperse uniformly on the surface of the toner particles. In addition, their stable spacer effects can decrease the physical adhesion of the toner.

Hereinafter, the method for producing the silica fine particles by the sol-gel method will be described. First, alkoxysilane is subjected to hydrolysis and condensation reactions with a catalyst in an organic solvent containing water to obtain a silica sol suspension. Then, the solvent is removed from the silica sol suspension, followed by drying to obtain silica fine particles. The present inventors have found that conditions for the reactions can be adjusted to thereby control the surface pore state of the silica fine particles. Under conditions where a short reaction time, for example, hinders the condensation reaction from proceeding, contraction tends to occur during drying, resulting in a small pore size or pore volume.

The silica fine particles thus obtained are usually hydrophilic and are rich in surface silanol groups. The silanol groups on the silica fine particles can therefore be dehydrated and condensed by heat treatment at 300° C. to 500° C. This dehydration and condensation of the silanol groups on the silica fine particles can decrease the amount of the silanol groups and can suppress the moisture absorption of the silica fine particles.

In the case of treating the silica fine particles with a hydrophobizing agent, the heat treatment at 300° C. to 500° C. may be performed before, after, or simultaneously with the hydrophobization treatment. When the heat treatment is performed after the hydrophobization treatment, the hydrophobizing agent may not produce the desired rate of fixation because of being thermally decomposed. In this respect, the heat treatment is preferably performed before the hydrophobization treatment.

The silica fine particles may be further subjected to cracking treatment for facilitating rendering the silica fine particles monodisperse on the surface of the toner particles and for exerting stable spacer effects. The cracking treatment can be performed before the surface treatment with the hydrophobizing agent. In this case, the surface of the silica fine particles can be uniformly treated with the hydrophobizing agent.

The amount of the silica fine particles B added can be 0.1 parts by mass or larger and 0.5 parts by mass or smaller with respect to 100 parts by mass of the magnetic toner particles.

<Number-Average Particle Size (D1) of Silica Fine Particles B as Primary Particles>

The number-average particle size (D1) of the silica fine particles B of the present invention as primary particles is 40 nm or larger and 200 nm or smaller. The silica fine particles B having the number-average particle size (D1) of 40 nm or larger as primary particles can be prevented from being buried in the toner particles and can exert their effects over a long period. The resulting toner can secure fluidity, etc. On the other hand, the silica fine particles B having the number-average particle size (D1) of 200 nm or smaller as primary particles can be readily deposited to cover the toner particles and can exert spacer effects.

In the present invention, the number-average particle size (D1) of the silica fine particles B as primary particles is measured by a method of magnifying and observing the state of the silica fine particles alone under a scanning electron microscope before external addition to the toner particles or magnifying and observing the surface of the toner particles after external addition to the toner particles. In this respect, the particle sizes of at least 300 silica fine particles are measured and averaged to obtain the number-average particle size (D1) of the primary particles. Detailed conditions for the measurement will be mentioned later.

<Quantification of Abundance Ratio of Secondary Particles of Silica Fine Particles B>

The abundance ratio of secondary particles of the silica fine particles B is quantified by the magnifying observation of the surface of the toner particles after external addition to the toner particles. In this respect, spherical fine particles having a primary particle size of 40 nm or larger and 200 nm or smaller are observed. For this measurement, independent spherical fine particles are regarded as primary particles, while a plurality of spherical fine particles present together are regarded as secondary particles. Some secondary particles may exist as an aggregate of two spherical fine particles, and others may exist as an aggregate of three or more spherical fine particles. These aggregates are each measured as one secondary particle. In this way, arbitrary 300 primary particles and secondary particles are observed to calculate the abundance ratio of the secondary particles. Detailed conditions for the measurement follow <Method for measuring number-average particle size of silica fine particles as primary particles> mentioned later.

In the magnetic toner of the present invention, for example, a lubricant (e.g., fluorine resin powders, zinc stearate powders and polyvinylidene fluoride powders), an abrasive (e.g., cerium oxide powders, silicon carbide powders and strontium titanate powders), and/or spacer particles (e.g., silica) may be used in small amounts without influencing the effects, in addition to the silica fine particles.

<External Addition and Mixing of Silica Fine Particles>

Figure 3:
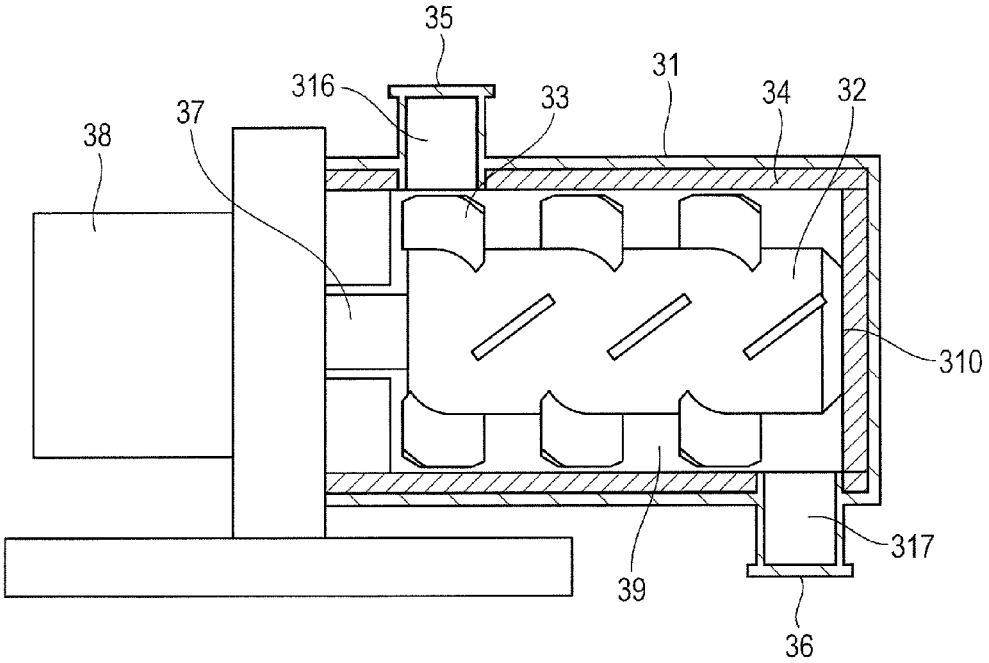
FIG. 3 is a schematic diagram illustrating one example of a mixing treatment apparatus that can be used in the external addition and mixing of inorganic fine particles.

A mixing treatment apparatus known in the art can be used as a mixing treatment apparatus for the external addition and mixing of the silica fine particles. An apparatus as illustrated in FIG. 3 can be used because the coverage ratio X1 and the diffusion index can be easily controlled. FIG. 3 is a schematic diagram illustrating one example of a mixing treatment apparatus that can be used in the external addition and mixing of the silica fine particles used in the present invention.

The mixing treatment apparatus is configured such that shear is applied to the toner particles and the silica fine particles in an area of narrow clearance. The silica fine particles can therefore be deposited on the surface of the toner particles while broken up from secondary particles into primary particles.

As mentioned later, the coverage ratio X1 and the diffusion index are easily controlled in ranges suitable for the present invention because the toner particles and the silica fine particles readily circulate in the axial direction of a rotator and are readily mixed thoroughly and uniformly before the progression of fixing.

Figure 4:
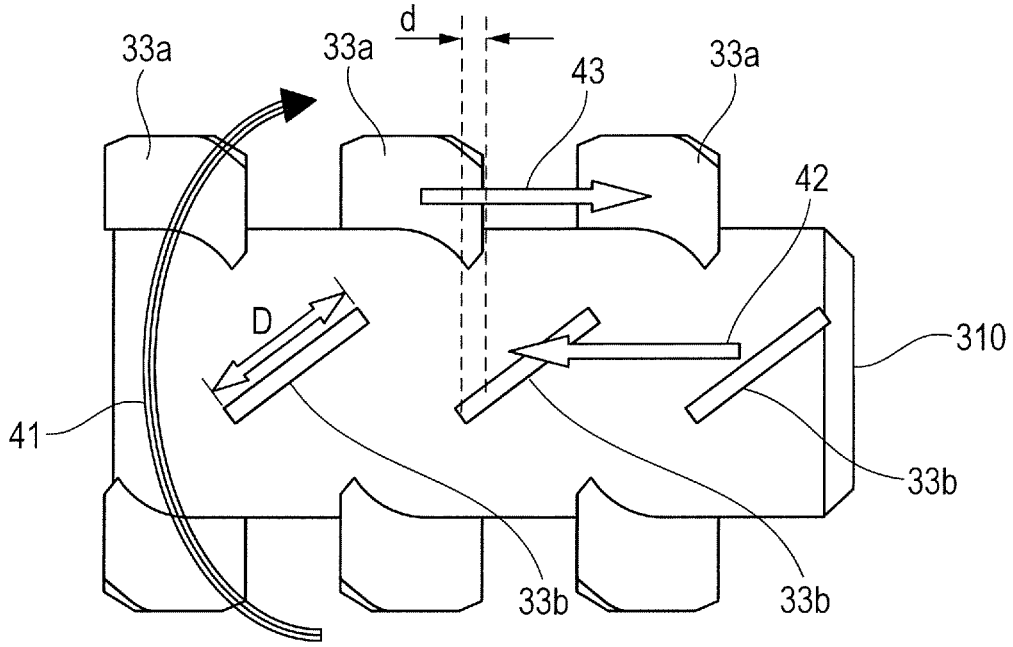
FIG. 4 is a schematic diagram illustrating one example of the configuration of a stirring member for use in the mixing treatment apparatus.

FIG. 4 is a schematic diagram illustrating one example of the configuration of a stirring member for use in the mixing treatment apparatus.

Hereinafter, the external addition and mixing process for the silica fine particles will be described with reference to FIGS. 3 and 4.

The mixing treatment apparatus for the external addition and mixing of the silica fine particles at least has a rotator 32 with a plurality of stirring members 33 disposed on its surface, a driving member 38 which drives the rotation of the rotator, and a main casing 31 disposed to have a gap with the stirring members 33.

It is important to keep the gap (clearance) between the inner periphery of the main casing 31 and the stirring members 33 constant and very small, for uniformly applying shear to the toner particles and facilitating depositing the silica fine particles on the surface of the toner particles while breaking up the silica fine particles from secondary particles into primary particles.

In this apparatus, the diameter of the inner periphery of the main casing 31 is twice or smaller the diameter of the outer periphery of the rotator 32. FIG. 3 illustrates an example in which the diameter of the inner periphery of the main casing 31 is 1.7 times the diameter of the outer periphery of the rotator 32 (diameter of the body of the rotator 32 except for the stirring members 33). When the diameter of the inner periphery of the main casing 31 is twice or smaller the diameter of the outer periphery of the rotator 32, the treatment space where force acts on the toner particles is moderately restricted so that impact force is sufficiently applied to the silica fine particles in the form of secondary particles.

It is also important to adjust the clearance according to the size of the main casing. The clearance is set to approximately 1% or more and approximately 5% or less of the diameter of the inner periphery of the main casing 31. This is important because sufficient shear can be applied to the silica fine particles. Specifically, when the inner periphery of the main casing 31 has a diameter on the order of 130 mm, the clearance may be set to approximately 2 mm or larger and approximately 5 mm or smaller. When the inner periphery of the main casing 31 has a diameter on the order of 800 mm, the clearance may be set to approximately 10 mm or larger and approximately 30 mm or smaller.

The external addition and mixing process for the silica fine particles according to the present invention employs the mixing treatment apparatus and involves rotating the rotator 32 by the driving member 38 and stirring and mixing the toner particles and the silica fine particles introduced into the mixing treatment apparatus to complete the external addition and mixing treatment of the silica fine particles to the surface of the toner particles.

As illustrated in FIG. 4, at least some of the plurality of stirring members 33 are provided as forward stirring members 33*a* which feed forward the toner particles and the silica fine particles in the axial direction of the rotator, with the rotation of the rotator 32. Also, at least some of the plurality of stirring members 33 are provided as backward stirring members 33*b* which feed backward the toner particles and the silica fine particles in the axial direction of the rotator, with the rotation of the rotator 32. In the case of the main casing 31 provided at both ends with a raw material inlet 35 and a product outlet 36, respectively, as illustrated in FIG. 3, the direction from the raw material inlet 35 toward the product outlet 36 (direction toward the right in FIG. 3) is referred to as a "forward direction".

Specifically, as illustrated in FIG. 4, the plate surfaces of the forward stirring members 33*a* are inclined so as to feed the toner particles and the silica fine particles in the forward direction 43. On the other hand, the plate surfaces of the stirring members 33*b* are inclined so as to feed the toner particles and the silica fine particles in the backward direction 42.

As a result, the external addition and mixing treatment of the silica fine particles to the surface of the toner particles is performed while feed in the "forward direction" 43 and feed in the "backward direction" 42 are repetitively performed. The stirring members 33*a* and 33*b* are formed as sets each involving a plurality of members 33*a* or 33*b* arranged at intervals in the circumferential direction of the rotator 32. In the example illustrated in FIG. 4, the stirring members 33*a* and 33*b* are formed as sets each involving two members 33*a* or 33*b* mutually arranged at an interval of 180 degrees on the rotator 32. Alternatively, a larger number of members may form one set, such as three members arranged at intervals of 120 degrees or four members arranged at intervals of 90 degrees.

In the example illustrated in FIG. 4, a total of 12 equally spaced stirring members 33*a* and 33*b* are formed.

In FIG. 4, D represents the width of each stirring member, and d represents a distance that indicates the overlap between the stirring members. The width represented by D can be approximately 20% or more and approximately 30% or less of the length of the rotator 32 in FIG. 4 from the viewpoint of efficiently feeding the toner particles and the silica fine particles in the forward direction and in the backward direction. In FIG. 4, the width represented by D is 23% of the length of the rotator 32. The stirring members 33*a* and 33*b* can have some degree of the overlap d between each stirring member 33*a* and each stirring member 33*b*, when a line is extended vertically from one end of the stirring member 33*a*.

This enables shear to be efficiently applied to the silica fine particles in the form of secondary particles. The ratio of d to D can be 10% or more and 30% or less in terms of the application of shear.

The shape of the stirring blade may be the shape as illustrated in FIG. 4 as well as a shape having a curved surface or a paddle structure in which the tip of the blade is connected to the rotator 32 through a rod-shaped arm, as long as the toner particles can be fed in the forward direction and in the backward direction and the clearance can be maintained.

Hereinafter, the present invention will be described in more detail with reference to the schematic diagrams of the apparatus illustrated in FIGS. 3 and 4. The apparatus illustrated in FIG. 3 at least has a rotator 32 with a plurality of stirring members 33 disposed on its surface, a driving member 38 which drives the rotation of the rotator 32 around a central axis 37, and a main casing disposed to have a gap with the stirring members 33. The apparatus further has a jacket 34 disposed on the inside of the main casing 31 and a side surface 310 of the end of the rotator, the jacket permitting flow of a cooling and heating medium.

The apparatus illustrated in FIG. 3 further has a raw material inlet 35 disposed at the top of the main casing 31, and a product outlet 36 disposed at the bottom of the main casing 31. The raw material inlet 35 is used for introducing the toner particles and the silica fine particles. The product outlet 36 is used for discharging the toner after external addition and mixing treatment from the main casing 31.

In the apparatus illustrated in FIG. 3, an inner piece 316 for a raw material inlet is inserted in the raw material inlet 35, and an inner piece 317 for a product outlet is inserted in the product outlet 36.

In the present invention, first, the inner piece 316 for a raw material inlet is removed from the raw material inlet 35, and the toner particles are introduced into a treatment space 39 from the raw material inlet 35. Next, the silica fine particles are introduced into the treatment space 39 from the raw material inlet 35, and the inner piece 316 for a raw material inlet is inserted into the raw material inlet 35. Next, the rotator 32 is rotated by the driving member 38 (reference numeral 41 denotes the direction of rotation) to perform external addition and mixing treatment while stirring and mixing the introduced materials to be treated using a plurality of stirring members 33 disposed on the surface of the rotator 32.

The order in which the raw materials are introduced may begin with the introduction of the silica fine particles from the raw material inlet 35 followed by the introduction of the toner particles from the raw material inlet 35. Alternatively, the toner particles and the silica fine particles may be mixed in advance using a mixing machine such as a Henschel mixer, and the resultant mixture can then be introduced from the raw material inlet 35 of the apparatus illustrated in FIG. 3.

As conditions for the external addition and mixing treatment, the power of the driving member 38 can be adjusted to 0.2 W/g or larger and 2.0 W/g or smaller for obtaining the coverage ratio X1 and the diffusion index stipulated by the present invention. The power of the driving member 38 is more preferably adjusted to 0.6 W/g or larger and 1.6 W/g or smaller. The power of 0.2 W/g or larger is less likely to decrease the coverage ratio X1 and prevents the diffusion index from becoming too low. On the other hand, the power of 2.0 W/g or smaller prevents the diffusion index from becoming too high. The resulting silica fine particles resist being buried too much in the toner particles.

The treatment time is not particularly limited and can be 3 minutes or longer and 10 minutes or shorter. A treatment time shorter than 3 minutes tends to decrease the coverage ratio X1 and the diffusion index.

The rotational speed of the stirring members during external addition and mixing is not particularly limited. When the apparatus illustrated in FIG. 3 has a volume of the treatment space 39 of $2.0\times10^{-3}$ $m^3$ and has the stirring members 33 shaped as illustrated in FIG. 4, the rotational speed of the stirring members can be 800 rpm or higher and 3000 rpm or lower. The coverage ratio X1 and diffusion index stipulated by the present invention can be easily obtained at the rotational speed of 800 rpm or higher and 3000 rpm or lower.

In the present invention, 2-step mixing can be performed which involves temporarily mixing the toner particles and the silica fine particles B and then adding and mixing the silica fine particles A to the mixture.

In the present invention, a particularly preferred treatment method further includes the respective premixing steps of the silica fine particles A and the silica fine particles B before the external addition and mixing process for the silica fine particles A or the silica fine particles B. Such additional premixing steps facilitate uniformly dispersing the silica fine particles at high levels on the surface of the toner particles, resulting in a high coverage ratio X1 and further a high diffusion index. More specifically, as conditions for the premixing treatment, the power of the driving member 38 can be set to 0.06 W/g or larger and 0.20 W/g or smaller, and the treatment time can be set to 0.5 minutes or longer and 1.5 minutes or smaller.

Under the premixing treatment conditions involving the load power of 0.06 W/g or larger or the treatment time of 0.5 minutes or longer, thorough and uniform mixing is achieved as premixing. On the other hand, under the premixing treatment conditions involving the load power of 0.20 W/g or smaller or the treatment time of 1.5 minutes or shorter, the silica fine particles are prevented from being fixed to the surface of the toner particles before thorough and uniform mixing.

When the apparatus illustrated in FIG. 3 has a volume of the treatment space 39 of $2.0\times10^{-3}$ $m^3$ and has the stirring members 33 shaped as illustrated in FIG. 4, the rotational speed of the stirring members in the premixing treatment can be 50 rpm or higher and 500 rpm or lower. The coverage ratio X1 and diffusion index stipulated by the present invention can be easily obtained at the rotational speed of 50 rpm or higher and 500 rpm or lower.

After the completion of the external addition and mixing treatment, the inner piece 317 for a product outlet is removed from the product outlet 36. The rotator 32 is rotated by the driving member 38 to discharge the toner from the product outlet 36. If necessary, coarse particles are separated from the obtained toner using a screen such as a circular vibrating screen to obtain toner.

<Particle Size and Circularity>

The weight-average particle size (D4) of the magnetic toner of the present invention is preferably 5.0 μm to 10.0 μm, more preferably 6.0 μm to 9.0 μm, from the viewpoint of obtaining excellent developability. Also, the average circularity of the toner particles according to the present invention can be 0.960 or higher. The toner particles having the average circularity of 0.960 or higher tend to yield toner having a (nearly) spherical shape and having excellent fluidity and uniform friction electrostatic properties. Ghosts can therefore be easily improved, and the resultant toner can readily maintain its high developability even after long term use. In addition, the coverage ratio X1 and the diffusion index of the toner particles having such a high average circularity can be easily controlled in the ranges of the present invention in the external addition treatment of inorganic fine particles mentioned later.

<Method for Producing Magnetic Toner>

Hereinafter, an exemplary method for producing the toner of the present invention will be described, though the production method of the present invention is not limited thereto. The magnetic toner particles contained in the toner of the present invention may be produced by a pulverization method.

Accordingly, the toner of the present invention is preferably produced in an aqueous medium by, for example, a dispersion polymerization method, an association agglomeration method, a solution suspension method or a suspension polymerization method and particularly preferably produced by a suspension polymerization method because the resultant toner tends to satisfy the suitable physical properties of the present invention.

In the suspension polymerization method, first, the magnetic material (and, if necessary, a polymerization initiator, a cross-linking agent, a charge control agent and other additives) is uniformly dispersed in a polymerizable monomer to obtain a polymerizable monomer composition. Then, the obtained polymerizable monomer composition is dispersed into a continuous layer (e.g., an aqueous phase) containing a dispersion stabilizer using an appropriate stirrer, and polymerization reaction is performed using the polymerization initiator to obtain magnetic toner particles having the desired particle size. The individual particles of the toner thus obtained by the suspension polymerization method (hereinafter, also referred to as "polymerized toner") commonly have a substantially spherical shape. Thus, the toner tends to satisfy the requirements for the suitable physical properties of the present invention.

Examples of the polymerizable monomer include: styrene monomers such as styrene, o-methylstyrene, m-methylstyrene, p-methylstyrene, p-methoxystyrene and p-ethylstyrene; acrylic acid esters such as methyl acrylate, ethyl acrylate, n-butyl acrylate, isobutyl acrylate, n-propyl acrylate, n-octyl acrylate, dodecyl acrylate, 2-ethylhexyl acrylate, stearyl acrylate, 2-chloroethyl acrylate and phenyl acrylate; methacrylic acid esters such as methyl methacrylate, ethyl methacrylate, n-propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate and diethylaminoethyl methacrylate; and other monomers such as acrylonitrile, methacrylonitrile and acrylamide. These monomers can be used alone or as a mixture. Among these monomers, styrene or a styrene derivative is preferably used alone or as a mixture with any of other monomers from the viewpoint of facilitating controlling the toner structure and improving the development characteristics and durability of the toner. Particularly, styrene and alkyl acrylate or styrene and alkyl methacrylate are more preferably used as the main components.

The polymerization initiator used in the production of the toner of the present invention by the polymerization method can have a half-life of 0.5 hours or longer and 30 hours or shorter during polymerization reaction. The polymerization initiator can be added in an amount of 0.5 parts by mass or larger and 20 parts by mass or smaller with respect to 100 parts by mass of the polymerizable monomer and used in polymerization reaction to obtain a polymerization product having a peak molecular weight between 5,000 or higher and 50,000 or lower, which imparts favorable strength and appropriate melting characteristics to the toner.

Specific examples of the polymerization initiator include: azo or diazo polymerization initiators such as 2,2'-azobis-(2,4-dimethylvaleronitrile), 2,2'-azobisisobutyronitrile, 1,1'-azobis(cyclohexane-1-carbonitrile), 2,2'-azobis-4-methoxy-2,4-dimethylvaleronitrile and azobisisobutyronitrile; and peroxide polymerization initiators such as benzoyl peroxide, methyl ethyl ketone peroxide, diisopropyl peroxycarbonate, cumene hydroperoxide, 2,4-dichlorobenzoyl peroxide, lauroyl peroxide, t-butyl peroxy-2-ethylhexanoate, t-butyl peroxypivalate, di(2-ethylhexyl) peroxydicarbonate and di(secondary butyl) peroxydicarbonate. Among these polymerization initiators, a peroxydicarbonate-type polymerization initiator di(2-ethylhexyl) peroxydicarbonate or di(secondary butyl) peroxydicarbonate is preferably used because a binder resin having a low molecular weight and a linear molecular structure can be easily produced.

For the production of the toner of the present invention by the polymerization method, a cross-linking agent may be added. The amount of the cross-linking agent added can be 0.001 parts by mass or larger and 15 parts by mass or smaller with respect to 100 parts by mass of the polymerizable monomer.

In this context, a compound having two or more polymerizable double bonds is mainly used as the cross-linking agent. For example, aromatic divinyl compounds (e.g., divinylbenzene and divinylnaphthalene), carboxylic acid esters having two double bonds (e.g., ethylene glycol diacrylate, ethylene glycol dimethacrylate and 1,3-butanediol dimethacrylate), divinyl compounds (e.g., divinylaniline, divinyl ether, divinyl sulfide and divinylsulfone) and compounds having 3 or more vinyl groups are used alone or as a mixture.

The polymerizable monomer composition can further contain a polar resin. Since the magnetic toner particles are produced in an aqueous medium in the suspension polymerization method, the polar resin contained therein can form a layer on the surface of the magnetic toner particles and can yield magnetic toner particles having a core/shell structure.

Such a core/shell structure increases the degree of freedom for the core and shell design. For example, a shell having a high glass transition temperature can prevent deterioration in durability such as the burying of silica. Also, a shell provided with masking effects tends to have homogeneous composition and therefore permits uniform charging.

Examples of the polar resin for the shell layer include: homopolymers of styrene and its substitution products, such as polystyrene and polyvinyltoluene; styrene copolymers such as styrene-propylene copolymers, styrene-vinyltoluene copolymers, styrene-vinylnaphthalene copolymers, styrene-methyl acrylate copolymers, styrene-ethyl acrylate copolymers, styrene-butyl acrylate copolymers, styrene-octyl acrylate copolymers, styrene-dimethylaminoethyl acrylate copolymers, styrene-methyl methacrylate copolymers, styrene-ethyl methacrylate copolymers, styrene-butyl methacrylate copolymers, styrene-dimethylaminoethyl methacrylate copolymers, styrene-vinyl methyl ether copolymers, styrene-vinyl ethyl ether copolymers, styrene-vinyl methyl ketone copolymers, styrene-butadiene copolymers, styrene-isoprene copolymers, styrene-maleic acid copolymers and styrene-maleic acid ester copolymers; and other resins such as polymethyl methacrylate, polybutyl methacrylate, polyvinyl acetate, polyethylene, polypropylene, polyvinylbutyral, silicone resins, polyester resins, styrene-polyester copolymers, polyacrylate-polyester copolymers, polymethacrylate-polyester copolymers, polyamide resins, epoxy resins, polyacrylic acid resins, terpene resins and phenol resins. These polar resins can be used alone or as a mixture. Alternatively, a functional group such as an amino group, a carboxyl group, a hydroxy group, a sulfonic acid group, a glycidyl group or a nitrile group may be introduced into these polymers. Among these resins, a polyester resin is preferred.

A saturated polyester resin or an unsaturated polyester resin, or both, can be appropriately selected and used as the polyester resin.

The polyester resin that can be used in the present invention usually contains an alcohol component and an acid component. Examples of these components will be given below.

Examples of dihydric alcohol components include ethylene glycol, propylene glycol, 1,3-butanediol, 1,4-butanediol, 2,3-butanediol, diethylene glycol, triethylene glycol, 1,5-pentanediol, 1,6-hexanediol, neopentyl glycol, 2-ethyl-1,3-hexanediol, cyclohexanedimethanol, butenediol, octenediol, cyclohexenedimethanol, hydrogenated bisphenol A, bisphenol derivatives represented by the formula (A):

(A)

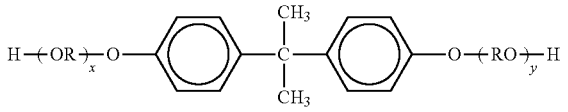

wherein R represents an ethylene or propylene group; x and y each represent an integer of 1 or larger, and an average value of x+y is 2 to 10, and hydrogenated compounds of the formula (A), and diols represented by the formula (B):

(B)

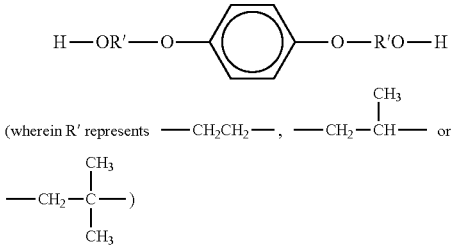

and hydrogenated diol compounds of the formula (B).

The dihydric alcohol component is particularly preferably an alkylene oxide adduct of the bisphenol A, which is excellent in charging characteristics and environmental stability and is well-balanced among other electrophotographic characteristics. For this compound, the average number of moles of the alkylene oxide added can be 2 or more and 10 or less in terms of fixability or toner durability.

Examples of divalent acid components include: benzenedicarboxylic acids and their anhydrides, such as phthalic acid, terephthalic acid, isophthalic acid and phthalic anhydride; alkyldicarboxylic acids and their anhydrides, such as succinic acid, adipic acid, sebacic acid and azelaic acid; succinic acids substituted by an alkyl or alkenyl group having 6 to 18 carbon atoms, and their anhydrides; and unsaturated dicarboxylic acids and their anhydrides, such as fumaric acid, maleic acid, citraconic acid and itaconic acid.

Examples of trihydric or higher alcohol components can include glycerin, pentaerythritol, sorbitol, sorbitan and oxyalkylene ethers of novolac phenol resins. Examples of trivalent or higher acid components can include trimellitic acid, pyromellitic acid, 1,2,3,4-butanetetracarboxylic acid, benzophenonetetracarboxylic acid and their anhydrides.

The polyester resin according to the present invention can contain 45% by mol or more and 55% by mol or less of the alcohol component and 45% by mol or more and 55% by mol or less of the acid component in the whole components.

The polyester resin according to the present invention can be produced using any catalyst such as a tin catalyst, an antimony catalyst or a titanium catalyst. A titanium catalyst is preferably used.

The polar resin for the shell can have a number-average molecular weight of 2500 or higher and 25000 or lower from the viewpoint of developability, blocking resistance and durability. In this context, the number-average molecular weight can be measured by GPC.

The polar resin for the shell can have an acid value of 6 mg KOH/g or higher and 10 mg KOH/g or lower. The polar resin having the acid value of 6 mg KOH/g or higher tends to form a homogeneous shell. The polar resin having the acid value of 10 mg KOH/g or lower tends to improve an image density because of small interaction between the magnetic material and the shell layer and the reduced aggregation properties of the magnetic material.

The polar resin for the shell layer can be contained in an amount of 2 parts by mass or larger and 10 parts by mass or smaller with respect to 100 parts by mass of the binder resin from the viewpoint of sufficiently obtaining effects brought about by the shell layer.

A dispersion stabilizer is contained in the aqueous medium where the polymerizable monomer composition is dispersed. A surfactant, an organic dispersant or an inorganic dispersant known in the art can be used as the dispersion stabilizer. Among these dispersion stabilizers, an inorganic dispersant can be preferably used because the inorganic dispersant produces dispersion stability based on its steric hindrance; thus the stability is less likely to be disrupted even at varying reaction temperatures, and because the inorganic dispersant can be readily washed off without adversely affecting the toner.

Examples of such inorganic dispersants include: phosphoric acid polyvalent metal salts such as tricalcium phosphate, magnesium phosphate, aluminum phosphate, zinc phosphate and hydroxyapatite; carbonates such as calcium carbonate and magnesium carbonate; inorganic salts such as calcium metasilicate, calcium sulfate and barium sulfate; and inorganic compounds such as calcium hydroxide, magnesium hydroxide and aluminum hydroxide.

The inorganic dispersant can be used in an amount of 0.2 parts by mass or larger and 20 parts by mass or smaller with respect to 100 parts by mass of the polymerizable monomer. These dispersion stabilizers may be used alone or in combination. A surfactant may be further used in combination therewith in an amount of 0.001 parts by mass or larger and 0.1 parts by mass or smaller. In the case of using any of these inorganic dispersants, the dispersant may be used directly and can be used after forming the inorganic dispersant particles in the aqueous medium in order to obtain finer particles.

In the case of, for example, tricalcium phosphate, an aqueous sodium phosphate solution can be mixed with an aqueous calcium chloride solution with high-speed stirring to form water-insoluble calcium phosphate, which permits more uniform and finer dispersion. In this case, water-soluble sodium chloride is also produced as a by-product. The presence of such a water-soluble salt in the aqueous medium is more convenient because the water-soluble salt prevents the polymerizable monomer from being dissolved in water and hinders ultrafine toner particles from being formed due to emulsion polymerization.

Examples of the surfactant include sodium dodecylbenzene sulfate, sodium tetradecyl sulfate, sodium pentadecyl sulfate, sodium octyl sulfate, sodium oleate, sodium laurate, sodium stearate and potassium stearate.

In the step of polymerizing the polymerizable monomer, the polymerization temperature is set to 40° C. or higher, generally a temperature of 50° C. or higher and 90° C. or lower. As a result of polymerization in this temperature range, the releasing agent to be contained in the toner particles is deposited by phase separation and more completely enclosed therein.

This step proceeds to a cooling step which involves cooling from a reaction temperature on the order of 50° C. or higher and 90° C. or lower to complete the polymerization reaction step. In this step, the cooling can be gradually performed for maintaining the compatible state of the releasing agent and the binder resin.

After the completion of the polymerization of the polymerizable monomer, the obtained polymerization product particles are filtered, washed and dried by methods known in the art to obtain toner particles. The toner particles thus obtained are mixed with the silica fine particles as mentioned above to thereby deposit the silica fine particles on the surface of the toner particles. In this way, the toner of the present invention can be obtained. Alternatively, the production process (before mixing of the silica fine particles) may further involve a classification step which can cut off coarse powders or fine powders from the toner particles.

Next, one example of an image forming apparatus in which the toner of the present invention can be suitably used will be described specifically with reference to FIGS. 1A and 1B.

FIG. 1A is a schematic diagram illustrating one example of the configuration of a developing unit 140. FIG. 1B is a schematic diagram illustrating one example of the configuration of an image forming apparatus equipped with the developing unit 140.

In FIG. 1A, the developing unit 140 has a rotatably disposed stirring member 141 which stirs toner contained therein, a developer bearing member 102 which has magnetic poles and carries toner for developing an electrostatic latent image on an electrostatic latent image-bearing member, and a toner-regulating member 142 which regulates the amount of toner on the developer bearing member 102.

Figure 1B:
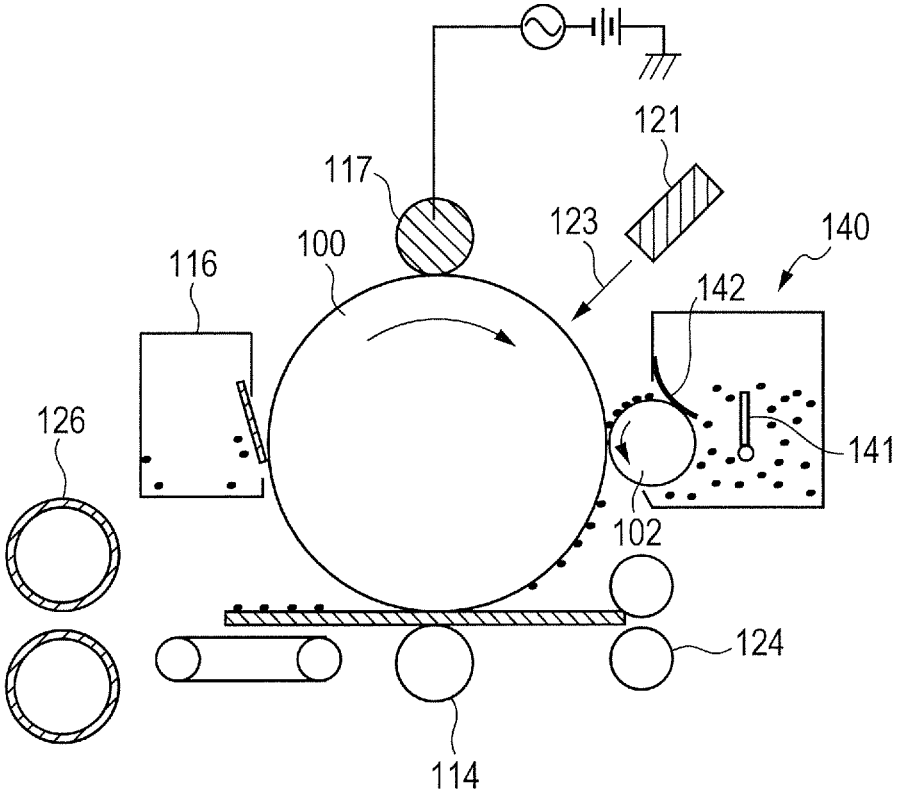
FIG. 1B is a schematic diagram illustrating one example of the configuration of an image forming apparatus equipped with the developing unit.

In FIG. 1B, reference numeral 100 denotes an electrostatic latent image-bearing member (hereinafter, also referred to as a photoreceptor) which is provided at its periphery with a charging member (charging roller) 117, the developing unit 140 having the developer bearing member 102, a transfer member (transfer charging roller) 114, a waste toner container 116, a fixing member 126, a pickup roller 124, and the like. The electrostatic latent image-bearing member 100 is charged by the charging roller 117. Then, the electrostatic latent image-bearing member 100 is irradiated with laser beam 123 by a laser generation apparatus 121 for light exposure to form an electrostatic latent image corresponding to the desired image. The electrostatic latent image on the electrostatic latent image-bearing member 100 is developed with single-component toner by the developing unit 140 to obtain a toner image. The toner image is transferred onto a transfer material by the transfer roller 114 contacted with the electrostatic latent image-bearing member via the transfer material. The transfer material with the toner image placed thereon is transported to the fixing member 126 where the toner image is fixed onto the transfer material. Also, toner remnants on the electrostatic latent image-bearing member are scraped off by a cleaning blade and held in the waste toner container 116.

Next, a method for measuring each physical property according to the present invention will be described.

<Method for Quantifying Silica Fine Particles>

(1) Determination of Content of Silica Fine Particles in Toner (Standard Addition Method)

Toner (3 g) is added to an aluminum ring of 30 mm in diameter, and a pellet is prepared at an pressure of 10 tons. Then, the intensity of silicon (Si) is measured (Si intensity-1) by wavelength-dispersive fluorescent X-ray analysis (XRF). The measurement conditions may be optimized with the XRF apparatus used. A series of intensity measurements are all carried out under the same conditions. Silica fine particles having a number-average particle size of 12 nm as primary particles are added in an amount of 1.0% by mass to the toner, and mixed using a coffee mill. The resultant mixture is pelletized in the same way as above, and the intensity of Si is determined in the same way as above (Si intensity-2). In addition, the Si intensities of samples of the toner supplemented and mixed with 2.0% by mass or 3.0% by mass of silica fine particles are also determined by similar operation (Si intensity-3 and Si intensity-4). The content (% by mass) of silica in the toner is calculated by the standard addition method using these Si intensities-1 to -4.

(2) Separation of Silica Fine Particles from Toner

When the toner contains the magnetic material, the silica fine particles are quantified through the following steps:

5 g of toner is weighed into a 200 mL plastic cup with cap using a precision scale. 100 mL of methanol is added to the cup where the toner is then dispersed for 5 minutes using an ultrasonic disperser. The toner is attracted with a neodymium magnet, and the supernatant is discarded. The operation of dispersing the toner in methanol and discarding the supernatant is repeated three times. Then, the following materials are added thereto and slightly mixed, and the mixture is then left standing for 24 hours. 10% NaOH 100 mL "Contaminon N" (aqueous solution containing 10% by mass of a neutral (pH 7) cleanser for cleaning of precision analyzers which is composed of a nonionic surfactant, an anionic surfactant and an organic builder; manufactured by Wako Pure Chemical Industries, Ltd.) Few drops Thereafter, separation is performed again using a neodymium magnet. The residue is repeatedly rinsed with distilled water such that NaOH does not remain. The recovered particles are thoroughly dried with a vacuum drier to obtain particles A. The externally added silica fine particles are dissolved and removed by the foregoing operation.

(3) Measurement of Intensity of Si in Particles a

The particles A (3 g) are added to an aluminum ring of 30 mm in diameter, and a pellet is prepared at an pressure of 10 tons. The intensity of Si is determined (Si intensity-5) by wavelength-dispersive fluorescent X-ray analysis (XRF). The content (% by mass) of silica in the particles A is calculated using Si intensity-5 and Si intensities-1 to -4 used in the determination of the content of silica in the toner.

(4) Separation of Magnetic Material from Toner 100 mL of tetrahydrofuran is added to 5 g of the particles A and well mixed, followed by ultrasonic dispersion for 10 minutes. The magnetic particles are attracted with a magnet, and the supernatant is discarded. This operation is repeated 5 times to obtain particles B. Almost all of organic components other than the magnetic material, such as resins, can be removed by this operation. Since tetrahydrofuran-insoluble matter derived from the resins might remain, the particles B thus obtained can be heated to 800° C. for the combustion of the remaining organic components. Particles C thus obtained by heating can be regarded as being approximated to the magnetic material contained in the toner.

The mass of the particles C can be measured to determine a content W (% by mass) of the magnetic material in the magnetic toner. In this respect, the mass of the particles C is multiplied by 0.9666 ($Fe_2O_3 \rightarrow Fe_3O_4$) in order to correct an amount increased by the oxidation of the magnetic material. Each quantitative value is substituted into the following expression to calculate the amount of the externally added silica fine particles.

Amount (% by mass)of the externally added silica fine particles=Content (% by mass) of silica in the toner−Content (% by mass) of silica in the particles A <Method for Measuring Coverage Ratio X1>

The coverage ratio X1 of the surface of the toner particles with the silica fine particles is calculated as follows:

The elemental analysis of the surface of the toner particles is conducted using the following apparatus under the following conditions:

Measurement apparatus: Quantum 2000 (trade name; manufactured by Ulvac-Phi, Inc.)

X-ray source: monochrome Al Kα

X-ray setting: 100 μmϕ (25 W (15 KV))

Photoelectron take-off angle: 45 degrees

Neutralization conditions: combined use of a neutralization gun and an ion gun

Analysis region: 300 μm×200 μm

Pass energy: 58.70 eV

Step size: 1.25 eV

Analysis software: PHI Multipak (manufactured by ULVAC-PHI, Inc)

In this context, the quantitative value of Si atoms was calculated using C 1c (B.E. 280 to 295 eV), O 1s (B.E. 525 to 540 eV) and Si 2p (B.E. 95 to 113 eV) peaks. The quantitative value of Si atoms thus obtained is designated as Y1.

Subsequently, the elemental analysis of the silica fine particles alone is conducted in the same way as in the elemental analysis of the surface of the toner particles. The quantitative value of Si atoms thus obtained is designated as Y2.

In the present invention, the coverage ratio X1 of the surface of the toner particles with the silica fine particles is defined according to the following expression using Y1 and Y2:

$$X1(\%\text{ by area})=(Y1/Y2)\times 100$$

In this context, Y1 and Y2 can be measured two or more times for improving the precision of the assay.

For the determination of the quantitative value Y2, the silica fine particles used in external addition may be used in the assay, if available.

In the case of using the silica fine particles separated from the surface of the toner particles as an assay sample, the separation of the silica fine particles from the toner particles is performed by procedures given below.

1) In the Case of Magnetic Toner

First, 6 mL of Contaminon N (aqueous solution containing 10% by mass of a neutral (pH 7) cleanser for cleaning of precision analyzers which is composed of a nonionic surfactant, an anionic surfactant and an organic builder; manufactured by Wako Pure Chemical Industries, Ltd.) is added to 100 mL of ion-exchanged water to prepare a dispersion medium. To this dispersion medium, 5 g of toner is added and dispersed for 5 minutes in an ultrasonic disperser. Then, the resultant dispersion is loaded in a "KM Shaker" (model: V. SX) manufactured by Iwaki Industry Co., Ltd., and reciprocally shaken for 20 minutes under conditions of 350 rpm.

Thereafter, the toner particles are held back with a neodymium magnet, and the supernatant is collected. This supernatant is dried to thereby collect the silica fine particles. If a sufficient amount of silica fine particles cannot be collected, this operation is repeatedly performed.

In this method, external additives other than the silica fine particles, if added, can also be collected. In such a case, the silica fine particles used can be sorted out from the collected external additives by a centrifugation method or the like.

2) In the Case of Nonmagnetic Toner 160 g of sucrose (manufactured by Kishida Chemical Co., Ltd.) is added to 100 mL of ion-exchanged water and dissolved using a hot water bath to prepare a sucrose syrup. 31 g of the sucrose syrup and 6 mL of Contaminon N are added to a centrifuge tube to prepare a dispersion. To this dispersion, 1 g of toner is added, and clumps of the toner are broken up with a spatula or the like.

The centrifuge tube is reciprocally shaken for 20 minutes under conditions of 350 rpm on the shaker mentioned above. The solution thus shaken is transferred to a 50 mL glass tube for swing rotors and centrifuged under conditions of 3500 rpm for 30 minutes in a centrifuge. In the glass tube thus centrifuged, toner is present in the uppermost layer while silica fine particles are present on the aqueous solution side serving as the bottom layer. The aqueous solution serving as the bottom layer is collected and centrifuged to separate the silica fine particles from the sucrose and thereby collect the silica fine particles. If necessary, centrifugation is repeatedly performed for thorough separation, followed by drying of the dispersion and collection of the silica fine particles.

As with the magnetic toner, external additives other than the silica fine particles, if added, can also be collected. The silica fine particles are therefore sorted out from the collected external additives by a centrifugation method or the like.

<Method for Measuring Weight-Average Particle Size (D4) of Toner>

The weight-average particle size (D4) of the toner (particles) is calculated as described below. The measurement apparatus used is a precision particle size distribution measurement apparatus "Coulter Counter Multisizer 3®" (manufactured by Beckman Coulter, Inc.) which is based on the pore electrical resistance method and equipped with a 100 μm aperture tube. Dedicated software "Beckman Coulter Multisizer 3, Version 3.51" (manufactured by Beckman Coulter, Inc.) attached to the apparatus is used for setting the measurement conditions and analyzing the measurement data. The measurement is performed with 25,000 effective measurement channels.

The aqueous electrolyte solution used in the measurements is prepared by the dissolution of special-grade sodium chloride at a concentration of 1% by mass in ion-exchanged water, and, for example, "ISOTON II" (manufactured by Beckman Coulter, Inc.) can be used.

The dedicated software is set as follows prior to measurement and analysis.

In the "Changing Standard Operating Mode (SOM)" screen of the dedicated software, the Total Count of the Control Mode is set to 50000 particles, and the Number of Runs and the Kd value are set to 1 and to the value obtained using "Standard particles 10.0 μm" (manufactured by Beckman Coulter), respectively. The "Threshold/Noise Level Measuring Button" is pressed to thereby automatically set the threshold and noise levels. Also, the Current is set to 1600 μA, the Gain is set to 2, and the Electrolyte Solution is set to ISOTON II. A check mark is placed in "Flush aperture tube following measurement".

In the "Setting Conversion from Pulses to Particle Size" screen of the dedicated software, the Bin Interval is set to a logarithmic particle size, the Particle Size Bin is set to 256 particle size bins, and the Particle Size Range is set to from 2 μm to 60 μm.

Specific measurement methods are as described below.

(1) 200 mL of the aqueous electrolyte solution is placed in a 250 mL round-bottomed glass beaker dedicated to Multisizer 3. The beaker is loaded on a sample stand and stirred counterclockwise with a stirrer rod at a speed of 24 rotations per second. Then, debris and air bubbles are removed from the aperture tube by the "Aperture Flush" function of the dedicated software.

(2) 30 mL of the aqueous electrolyte solution is placed in a 100 mL flat-bottomed glass beaker. 0.3 mL of a dilution containing a dispersant "Contaminon N" (aqueous solution containing 10% by mass of a neutral (pH 7) cleanser for cleaning of precision analyzers which is composed of a nonionic surfactant, an anionic surfactant and an organic builder; manufactured by Wako Pure Chemical Industries, Ltd.) diluted 3-fold by mass with ion-exchanged water is added into the beaker.

(3) "Ultrasonic Dispersion System Tetora 150" (manufactured by Nikkaki Bios Co., Ltd.) is prepared as an ultrasonic disperser having an electrical output of 120 W and internally equipped with two oscillators that oscillate at a frequency of 50 kHz and are disposed at a phase offset of 180 degrees. 3.3 L of ion-exchanged water is placed in the water tank of the ultrasonic disperser, and 2 mL of Contaminon N is added to the water tank.

(4) The beaker prepared in (2) is loaded in a beaker-securing hole of the ultrasonic disperser, which is in turn operated. Then, the height position of the beaker is adjusted so as to maximize the resonance state of the liquid level of the aqueous electrolyte solution in the beaker.

(5) While the aqueous electrolyte solution in the beaker of (4) is ultrasonically irradiated, 10 mg of toner is added in small portions to the aqueous electrolyte solution and dispersed therein. Then, the ultrasonic dispersion treatment is further continued for 60 seconds. For this ultrasonic dispersion, the temperature of water in the water tank is appropriately adjusted to 10° C. or higher and 40° C. or lower.

(6) The aqueous electrolyte solution of (5) containing the dispersed toner is added dropwise using a pipette to the round-bottomed beaker of (1) loaded in the sample stand to adjust the measurement concentration to 5%. Then, the measurement is performed until the number of measured particles reaches 50000.

(7) The measurement data is analyzed using the dedicated software attached to the apparatus to calculate the weight-average particle size (D4). In this context, when Graph/% by Volume is selected in the dedicated software, the "Average Size" in the "Analysis/Volume Statistics (arithmetic average)" screen is the weight-average particle size (D4).

<Method for Measuring Number-Average Particle Size of Silica Fine Particles as Primary Particles>

The number-average particle size of the silica fine particles as primary particles is calculated from images of the silica fine particles on the surface of the toner particles taken under a Hitachi ultrahigh-resolution field-emission scanning electron microscope S-4800 (Hitachi High-Technologies Corporation). The S-4800 image-capturing conditions are as described below.

(1) Sample Preparation

A light coating of conductive paste is applied over a microscope stage (15 mm×6 mm aluminum stage), and toner is sprayed thereonto. Air is further blown over the toner to remove redundant toner from the stage and thereby thoroughly dry the coating. The stage is loaded in a sample holder, and the stage height is adjusted to 36 mm with a sample height gauge.

(2) Setting of S-4800 Observation Conditions

The number-average particle size of the silica fine particles as primary particles is calculated using images obtained by the S-4800 observation of backscattered electron images. Since less charge-up of the silica fine particles occurs in the backscattered electron images compared with secondary electron images, the particle size of the silica fine particles can be precisely measured.

Liquid nitrogen is poured until overflowing into an anti-contamination trap mounted on the S-4800 microscope body, and left for 30 minutes. Next, "PC-SEM" of S-4800 is booted up to perform flushing (cleaning of the FE chip serving as an electron source). The acceleration voltage indicator of the control panel on the screen is clicked, and the [Flushing] button is pressed to open the flushing execution dialog.

After confirmation that the flushing intensity is 2, the flushing is executed. The emission current attributed to the flushing is confirmed to be 20 to 40 μA. The sample holder is inserted in the sample chamber of the S-4800 microscope body. [Home] on the control panel is pressed to move the sample holder to the observation position.

The acceleration voltage indicator is clicked to open the HV control dialog. The acceleration voltage is set to [0.8 kV], and the emission current is set to [20 μA]. Within the [Basic] tab on the operation panel, the signal selection is set to [SE], and [Up (U)] and [+BSE] are selected as SE detectors. In the right selection box of [+BSE], [L.A. 100] is selected to thereby set the microscope in a mode for the observation of backscattered electron images.

Likewise, within the [Basic] tab on the operation panel, the probe current in the Electron Optical Condition block is set to [Normal], the focus mode is set to [UHR], and WD is set to [3.0 mm]. The [ON] button of the acceleration voltage indicator on the control panel is pressed for the application of acceleration voltage.

(3) Calculation of Number-Average Particle Size (D1) ("da" for Use in Calculation of Theoretical Coverage Ratio) of Silica Fine Particles The magnification indicator on the control panel is dragged to set the magnification to ×100000 (100 k). The focus knob [COARSE] on the operation panel is turned. Once the image is in focus to some extent, the aperture alignment is adjusted. [Align] on the control panel is clicked to display the alignment dialog where [Beam] is then selected. The STIGMA/ALIGNMENT knobs (X, Y) on the operation panel are turned so as to move the displayed beam to the center of the concentric circle.

Next, [Aperture] is selected, and the STIGMA/ALIGNMENT knobs (X, Y) are turned one at a time and adjusted so as to stop or minimize image movement. The aperture dialog is closed, and the focus is adjusted using autofocus. This operation is repeated two more times to adjust the focus.

Then, the particle sizes of at least 300 silica fine particles on the surface of the toner particles are measured to determine an average particle size. In this context, some silica fine particles are present as aggregates. Thus, the maximum diameters of silica fine particles that can be confirmed as primary particles are determined and arithmetically averaged to obtain the number-average particle size (D1) of the silica fine particles as primary particles.

<Measurement of Isolation Rate of Silica Fine Particles>

Sample Preparation

Toner before release: Various toner samples prepared in Examples below were used directly.

Toner after release: 20 g of "Contaminon N" (aqueous solution containing 2% by mass of a neutral (pH 7) cleanser for cleaning of precision analyzers which is composed of a nonionic surfactant, an anionic surfactant and an organic builder) is weighed into a 50 mL vial and mixed with 1 g of toner. The vial is loaded in "KM Shaker" (model: V. SX) manufactured by Iwaki Industry Co., Ltd., and shaken for 30 seconds at a speed set to 50. Then, the toner is separated from the aqueous solution using a centrifuge (1000 rpm, 5 min). The supernatant is removed, and the toner precipitate is dried in vacuum to prepare a sample.

External additive-free toner: The external additive-free toner refers to toner in a state from which releasable external additives have been removed for this test. In the method for sample preparation, toner is added to a solvent, such as isopropanol, which does not dissolve the toner, and shaken for 10 minutes in an ultrasonic washing machine. Then, the toner is separated from the solution using a centrifuge (1000 rpm, 5 min). The supernatant is removed, and the toner precipitate is dried in vacuum to prepare a sample.

The silica fine particles in these samples before and after removal of releasable external additives were quantified by wavelength-dispersive fluorescent X-ray analysis (XRF) using the intensity of Si to determine the degree of their release.

(i) Exemplary Apparatus Used

Fluorescent X-ray analysis apparatus 3080 (Rigaku Corporation)

Sample press molding machine MAEKAWA Testing Machine (manufactured by MFG Co., Ltd.)

(ii) Measurement Conditions

Potential and voltage for measurement: 50 kV, 50 to 70 mA

2θ angle: 25.12°

Crystal plate: LiF

Measurement time: 60 sec (iii) Method for Calculating Isolation Rate from Toner

First, the element intensities of the toner before release, the toner after release and the external additive-free toner are determined by the method mentioned above. Then, the isolation rate is calculated according to the following expression:

Isolation rate of the silica fine particles=100−(Si atom intensity of the toner after release−Si atom intensity of the external additive-free toner)/(Si atom intensity of the toner before release−Si atom intensity of the external additive-free toner)×100 [Expression]

<Total Energy>

(A) Measurement of Total Energy

The total energy and the flow rate index FRI according to the present invention are measured using a "powder fluidity analysis apparatus Powder Rheometer FT4" (manufactured by Freeman Technology; hereinafter, also simply referred to as FT4).

Specifically, the measurement is performed by operations described below.

For all the operations, the propeller-type blade used is a 48 mm diameter blade dedicated to FT4 (see FIG. 3; model: C210, material: SUS; hereinafter, also simply referred to as a blade). In this propeller-type blade, the axis of rotation exists in the normal direction at the center of a 48 mm×10 mm blade plate. The blade plate is smoothly twisted counterclockwise by 70° at both outermost end portions thereof (portions 24 mm from the axis of rotation) and by 35° at portions 12 mm from the axis of rotation.

The measurement vessel used is a cylindrical split vessel dedicated to FT4 (model: C203, material: glass, diameter: 50 mm, volume: 160 mL, height from the bottom to the split portion: 82 mm; hereinafter, also simply referred to as a vessel).

(1) Compacting operation (a) Preliminary Experiment: A Piston for compacting tests is inserted in the main body. Approximately 50 mL of toner (its weight is measured in advance) is placed in the measurement vessel. The piston is moved down at a rate of 0.5 mm/sec to compact the toner. When the load to the piston reaches 20 N, the down movement is stopped. In this state, the piston is held for 20 seconds. The volume of the compacted toner is read from the scale of the vessel.

(b) Toner (fresh toner is used instead of the toner used in the preliminary experiment) is placed in the measurement vessel in ¼ of an amount corresponding to 180 mL as the volume of the compacted toner calculated by the preliminary experiment, and subjected to the same operation as in the preliminary experiment.

(c) The operation of (b) is performed 3 more times (a total of 4 times) while toner is added each time.

(d) The compacted toner layer is scraped flat at the split portion of the measurement vessel to remove the toner at the top of the powder layer.

(2) Total Energy Measurement Operation (a) The propeller-type blade is inserted in the main body. The propeller-type blade is rotated counterclockwise with respect to the surface of the powder layer (in the direction where the blade rotation pushes the powder layer in) at a peripheral speed of 10 mm/sec at the outermost ends of the blade. This blade is vertically advanced from the surface of the powder layer to a position 10 mm from the bottom of the powder layer at a speed of entry that forms an angle of 5°. Then, the blade is rotated clockwise with respect to the surface of the powder layer at a peripheral speed of 60 mm/sec at the outermost ends of the blade, and vertically advanced to a position 1 mm from the bottom of the powder layer at a speed of entry that forms an angle of 2°.

The blade is further moved to a position 100 mm from the bottom of the powder layer at a speed of withdrawal that forms an angle of 5°. After the completion of the withdrawal, the blade is slightly rotated alternately in the clockwise and counterclockwise directions to knock off toner attached to the blade.

(b) The operation of (2)-(a) is performed 6 more times (a total of 7 times). The total energy is defined as the total sum of the rotational torque and the perpendicular load obtained at the final run when the blade is advanced from a position 100 mm to a position 10 mm from the bottom of the powder layer.

<Method for Measuring Average Circularity of Toner Particles>

The average circularity of the toner particles is measured with a flow-type particle image analysis apparatus "FPIA-3000" (manufactured by Sysmex Corporation) under measurement and analysis conditions of the calibration process.

Specifically, the measurement method is as follows: first, 20 mL of ion-exchanged water from which solid impurities, etc. have been removed in advance is placed in a glass vessel. 0.2 mL of a dilution containing a dispersant "Contaminon N" (aqueous solution containing 10% by mass of a neutral (pH 7) cleanser for cleaning of precision analyzers which is composed of a nonionic surfactant, an anionic surfactant and an organic builder; manufactured by Wako Pure Chemical Industries, Ltd.) diluted 3-fold by mass with ion-exchanged water is added to this vessel.

Further, 0.02 g of the assay sample is added thereto and dispersed for 2 minutes using an ultrasonic disperser to prepare a dispersion for measurement. This dispersion is appropriately cooled such that its temperature falls within the range of 10° C. or higher and 40° C. or lower. The ultrasonic disperser used is a desktop ultrasonic cleaner/disperser (e.g., "VS-150" manufactured by Velvo-Clear) having an oscillation frequency of 50 kHz and an electrical output of 150 W. A given amount of ion-exchanged water is placed in the water tank, and 2 mL of the Contaminon N is added to this water tank.

The flow-type particle image analysis apparatus equipped with "UPlanApo" (magnification: ×10, numerical aperture: 0.40) as an object lens is used in the measurement. The sheath solution used is a particle sheath "PSE-900A" (manufactured by Sysmex Corporation). The dispersion prepared according to the foregoing procedures is introduced to the flow-type particle image analysis apparatus, and 3000 toner particles are measured in the HPF measurement mode and in the total count mode. Then, the binarization threshold for the particle analysis is set to 85%, and the analyzed particle size is limited to a circle-equivalent diameter of 1.985 μm or larger and smaller than 39.69 μm. Under these conditions, the average circularity of the toner particles is determined.

For the measurement, automatic focusing is performed before the start of the measurement using reference latex particles (e.g., a dilution of "RESEARCH AND TEST PARTICLES Latex Microsphere Suspensions 5200A" manufactured by Duke Scientific Corporation with ion-exchanged water). Then, focusing can be carried out every 2 hours from the start of measurement.

In the present invention, the flow-type particle image analysis apparatus is used which has been calibrated by Sysmex Corporation and given a calibration certificate issued by Sysmex Corporation. The measurement is performed under the same measurement and analysis conditions as those in receipt of the calibration certification except that the analyzed particle size is limited to a circle-equivalent diameter of 1.985 μm or larger and smaller than 39.69 μm.

The measurement principles of the flow-type particle image analysis apparatus "FPIA-3000" (manufactured by Sysmex Corporation) are to capture flowing particles as still images and conduct image analysis. Each sample added to the sample chamber is fed into a flat sheath flow cell by a sample suction syringe. The sample fed into the flat sheath flow cell is sandwiched within the sheath solution to form a flat flow.

The sample passing through the flat sheath flow cell can be irradiated with strobe light at 1/60-second intervals to capture the flowing particles as still images. Because of the flat flow, the images are taken in focus. The particle images are captured with a CCD camera, and the captured images are processed with an image processing resolution of 512×512 pixels (0.37×0.37 μm per pixel), followed by the contour definition of each particle image to measure a projected area S, a perimeter L, etc. of the particle image.

Next, the circle-equivalent diameter and the circularity are determined using the area S and the perimeter L. The circle-equivalent diameter refers to the diameter of a circle that has the same area as the projected area of the particle image. The circularity is defined as a value obtained by dividing the perimeter of the circle determined from the circle-equivalent diameter by the perimeter of the projection image of the particle, and calculated according to the following expression:

$$\text{Circularity}=2\times(\pi\times S)^{1/2}/L$$

When the particle image is circular, the circularity is 1.000. As the degree of irregularities in the circumference of the particle image becomes larger, the circularity assumes a smaller value. After calculation of the circularity of each particle, the circularity range from 0.200 to 1.000 is divided by 800. The arithmetic average of the obtained circularities is calculated, and this value is regarded as the average circularity.

<Method for Measuring Acid Value of Polyester Resin>

The acid value of a polyester resin is measured according to JIS K1557-1970. Specifically, the measurement method is as follows: 2.0 g of a pulverized product of each sample is precisely weighed (W (g)). The sample is placed in a 200 mL Erlenmeyer flask and dissolved for 5 hours after addition of 100 mL of a toluene/ethanol (2:1) mixed solution. A phenolphthalein solution is added thereto as an indicator. As for 0.1 N KOH, the solution mentioned above is also titrated using an alcohol solution and a burette. The amount of this KOH solution is designated as S (mL). A blank test is conducted, and the amount of this KOH solution is designated as B (mL).

The acid value is calculated according to the following expression:

$$\text{Acid value}=[(S-B)\times f\times 5.61]/W$$

(f: factor of the KOH solution)

<Method for Measuring Amount of Component Eluted by Styrene of Silane Compound Contained in Treated Magnetic Material>

20 g of styrene and 1.0 g of the treated magnetic material are mixed in a 50 mL glass vial. The glass vial is loaded in "KM Shaker" (model: V. SX) manufactured by Iwaki Industry Co., Ltd. The vial is shaken for 1 hour at a speed set to 50 to elute the treatment agent from the treated magnetic material into styrene. Then, the treated magnetic material is separated from the styrene and thoroughly dried in a vacuum drier.

The amount of carbon per unit weight of the dried treated magnetic material and the treated magnetic material before the elution into styrene is measured using a carbon/sulfur analysis apparatus EMIA-320V manufactured by HORIBA, Ltd. The rate of elution of the silane compound contained in the treated magnetic material into styrene is calculated using the amounts of carbon before and after the elution into styrene. In this context, the amount of the sample mixed for the EMIA-320V measurement is set to 0.20 g, and tungsten and tin are used as combustion improvers.

EXAMPLES

Hereinafter, the present invention will be described more specifically with reference to Production Examples and Examples. However, the present invention is not intended to be limited by these examples by any means. In Examples given below, the unit "part" in each formulation represents part by mass.

<Preparation of Developer Bearing Member>

Figure 5:
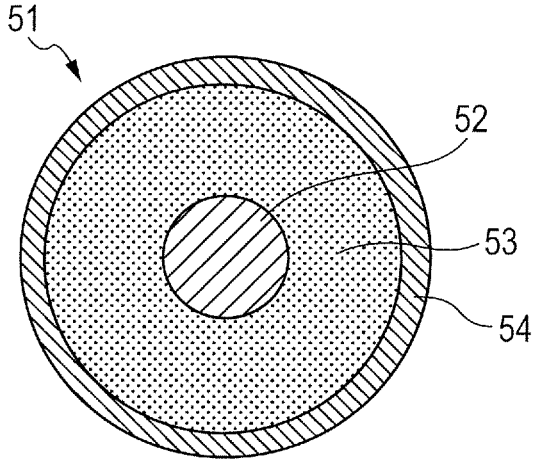
FIG. 5 is a schematic diagram illustrating one example of the configuration of a developer bearing member.

The preparation of a developer bearing member 51 will be described with reference to FIG. 5.

(Synthesis of Isocyanate-Terminated Prepolymer A-1)

In a nitrogen atmosphere, 100.0 g of butylene adipate polyol (trade name: Nippolan 4010, manufactured by Nippon Polyurethane Industry Co., Ltd.) was gradually added dropwise to 33.8 parts by mass of polymeric MDI (trade name: Millionate MR, manufactured by Nippon Polyurethane Industry Co., Ltd.) in a reaction vessel with the temperature in the reaction vessel kept at 65° C. After the completion of the dropwise addition, the reaction was performed at a temperature of 65° C. for 2 hours. The obtained reaction mixture was cooled to room temperature to obtain an isocyanate-terminated prepolymer A-1 having an isocyanate group content of 4.3% by mass.

(Preparation of Base)

For a base 52, a primer (trade name: DY35-051, manufactured by Dow Corning Toray Corporation) was applied and baked to a grinding-processed cylindrical aluminum tube having an outside diameter of 10 mmϕ (diameter) and an arithmetic mean roughness Ra of 0.2 μm.

(Preparation of Elastic Roller)

The base 52 thus prepared was disposed in a mold, and an addition silicone rubber composition prepared by the mixing of materials given below was injected into a cavity formed in the mold.

Liquid silicone rubber material (trade name: SE6724A/B, manufactured by Dow Corning Toray Corporation)

100 parts by mass

Carbon black (trade name: TOKA BLACK #4300, manufactured by Tokai Carbon Co., Ltd.)

15 parts by mass

Silica powder as heat resistance-imparting agent 0.2 parts by mass

Platinum catalyst 0.1 parts by mass

Subsequently, the mold was heated so that the silicone rubber was vulcanized and cured at a temperature of 150° C. for 15 minutes. The base 52 with the cured silicone rubber layer 53 formed on its periphery was removed from the mold. Then, the base was further heated at a temperature of 180° C. for 1 hour to complete the curing reaction of the silicone rubber layer 53. In this way, an elastic roller D-2 in which the silicone rubber elastic layer 53 having a film thickness of 0.5 mm and a diameter of 11 mm was formed on the outer periphery of the base 52 was prepared.

(Preparation of Surface Layer)

Materials given below were mixed as materials for a surface layer 54 and stirred.

Isocyanate-terminated prepolymer A-1

632.8 parts by mass

Pentaerythritol 19.5 parts by mass

Carbon black (trade name: MA230, manufactured by Mitsubishi Chemical Corporation)

117.4 parts by mass

Urethane resin fine particles (trade name: Art Pearl C-400, manufactured by Negami Chemical Industrial Co., Ltd.)

130.5 parts by mass

Next, the total solid content was adjusted to 30% by mass by the addition of MEK (methylethyl ketone) to prepare a coating material for surface layer formation.

Subsequently, the elastic roller D-2 prepared above was vertically erected with its rubber-free portion masked, and rotated at 1500 rpm. While a spray gun was moved down at a rate of 30 mm/sec, the coating material was applied thereto. Subsequently, the coating layer was cured and dried by heating at a temperature of 180° C. for 20 minutes in a hot-air drying furnace to prepare a developer bearing member 51 in which a surface layer having a film thickness of 8 μm was disposed on the outer periphery of the elastic layer.

Production Example of Magnetic Material 1.0 equivalent of a caustic soda solution with respect to iron ions (containing 1% by mass of sodium hexametaphosphate based on P with respect to Fe) was mixed into an aqueous ferrous sulfate solution to prepare an aqueous solution containing ferrous hydroxide. While air was blown into the aqueous solution with its pH kept at 9, oxidation reaction was performed at 80° C. to prepare a slurry solution for formation of seed crystals.

Subsequently, an aqueous ferrous sulfate solution was added at 1.0 equivalent with respect to the initial amount of the alkali (sodium component in the caustic soda) to this slurry solution. While air was blown into the slurry solution with its pH kept at 8, oxidation reaction was allowed to proceed. At the termination of the oxidation reaction, the pH was adjusted to 6. 1.5 parts by mass of a silane coupling agent $n\text{-}C_6H_{13}Si(OCH_3)_3$ was added with respect to 100 parts by mass of magnetic iron oxide and sufficiently stirred. The formed hydrophobic iron oxide particles were washed, filtered and dried by routine methods. After cracking treatment of aggregated particles, a magnetic material was obtained by heat treatment at a temperature of 70° C. for 5 hours.

The magnetic material had an average particle size of 0.25 μm and exhibited saturated magnetization and remnant magnetization of 67.3 $Am^2/kg$ (emu/g) and 4.0 $Am^2/kg$ (emu/g), respectively, in a magnetic field of 79.6 kA/m (1000 oersteds).

<Synthesis of Polyester Resin>

Components given below were placed in a reactor equipped with a cooling tube, a stirrer and a nitrogen inlet tube, and reacted at 230° C. for 10 hours while water generated under the current of nitrogen gas was distilled off.

Bisphenol A EO 2-mol adduct 350 parts by mass
Bisphenol A PO 2-mol adduct 326 parts by mass
Terephthalic acid 250 parts by mass
Titanium catalyst (titanium dihydroxybis(triethanolaminate))
2 parts by mass Subsequently, reaction was performed under reduced pressure of 5 to 20 mmHg. When the acid value reached 0.1 mg KOH/g or lower, the reaction product was cooled to 180° C. 80 parts by mass of trimellitic anhydride were added thereto. After reaction at normal pressure for 2 hours under sealed conditions, the reaction product was taken out, cooled to room temperature and then pulverized to obtain a polyester resin. The obtained resin had an acid value of 8 mg KOH/g.

<Production of Magnetic Toner Particles>

450 parts by mass of a 0.1 mol/L aqueous $Na_3PO_4$ solution were added to 720 parts of ion-exchanged water, and the mixture was heated to a temperature of 60° C. Then, 67.7 parts by mass of a 1.0 mol/L aqueous $CaCl_2$ solution were added thereto to obtain an aqueous medium containing the dispersion stabilizer.

Styrene 78 parts by mass
n-Butyl acrylate 22 parts by mass
Divinylbenzene 0.5 parts by mass
Polyester resin 3 parts by mass
Negative charge control agent T-77 (manufactured by Hodogaya Chemical Co., Ltd.) 1 part by mass
Magnetic material 70 parts by mass The formulation mentioned above was uniformly dispersed and mixed using an attritor (Nippon Coke & Engineering. Co., Ltd. (formerly Mitsui Miike Machinery Co., Ltd.)). This monomer composition was heated to a temperature of 60° C. Materials given below were mixed and dissolved therein to prepare a polymerizable monomer composition.

Releasing agent (paraffin wax (HNP-9, manufactured by Nippon Seiro Co., Ltd.)) 15 parts by mass
Polymerization initiator (t-butyl peroxypivalate (25% toluene solution)) 10 parts by mass The polymerizable monomer composition was added into the aqueous medium and stirred at 10,000 rpm at a temperature of 60° C. for 15 minutes in a $N_2$ atmosphere using a TK homomixer (PRIMIX Corporation (former Tokushu Kika Kogyo Co., Ltd.)) for granulation. Then, the mixture was stirred using a paddle stirring blade and subjected to polymerization reaction at a reaction temperature of 70° C. for 300 minutes. Then, the suspension was cooled to room temperature at a rate of 3° C./min. Hydrochloric acid was added thereto to dissolve the dispersant, followed by filtration, washing with water and drying to obtain magnetic toner particles 1. The magnetic toner particles 1 had a weight-average particle size (D4) of 8.0 μm and an average circularity of 0.975.

Production Example 1 of Silica Fine Particles A

A silica bulk (fumed silica having a number-average particle size of 10 nm as primary particles) was introduced into an autoclave with a stirrer and heated to 200° C. in a fluidized state with stirring.

The interior of the reactor was purged with nitrogen gas. The reactor was sealed, and 25 parts by mass of hexamethyldisilazane with respect to 100 parts by mass of the silica bulk were sprayed to the inside of the reactor to treat the silica with the silane compound in a fluidized state. This reaction was continued for 60 minutes and then terminated. After the completion of the reaction, the autoclave was depressurized and washed by the current of nitrogen gas to remove excessive hexamethyldisilazane and by-products from the hydrophobic silica.

While the hydrophobic silica was further stirred in the reactor, 10 parts by mass of dimethylsilicone oil (kinematic viscosity: 100 $mm^2$/sec) with respect to 100 parts by mass of the silica bulk were sprayed to the inside of the reactor where the stirring was then continued for 30 minutes. Then, the temperature was raised to 300° C. with stirring, and the stirring was further continued for 2 hours. Then, the resultant particles were taken out and subjected to cracking treatment to obtain silica fine particles A1. The physical properties of the silica fine particles A1 are shown in Table 1.

Production Examples 2 to 5 of Silica Fine Particles A

Silica fine particles A2 to A5 were obtained in the same way as in the Production Example of the silica fine particles A1 except that the particle size of the untreated silica used was changed and the cracking treatment intensity was appropriately adjusted. The physical properties of the silica fine particles A2 to A5 are shown in Table 1.

TABLE 1

| | Number-average particle size of primary particles [nm] | BET specific surface area [$m^2$/g] | True density [g/$cm^3$] |
|---|---|---|---|
| Silica fine particles A1 | 10 | 120 | 2.2 |
| Silica fine particles A2 | 5 | 200 | 2.2 |
| Silica fine particles A3 | 20 | 60 | 2.2 |
| Silica fine particles A4 | 25 | 50 | 2.2 |
| Silica fine particles A5 | 100 | 20 | 2.2 |

Production Example 1 of Silica Fine Particles B 687.9 g of methanol, 42.0 g of pure water and 47.1 g of 28% by mass of ammonia water were placed and mixed in a 3 L glass reactor equipped with a stirrer, a dropping funnel and a thermometer. The temperature of the obtained solution was adjusted to 35° C., and the addition of 1100.0 g (7.23 mol) of tetramethoxysilane and 395.2 g of 5.4% by mass of ammonia water was simultaneously started with stirring. The tetramethoxysilane was added dropwise over 5 hours, while the ammonia water was added dropwise over 4 hours.

After the completion of the dropwise addition, the stirring was further continued for 0.2 hours for hydrolysis to obtain a methanol-water dispersion of hydrophilic spherical sol-gel silica fine particles. Subsequently, an ester adapter and a cooling tube were mounted to the glass reactor, and the dispersion was heated to 65° C. to distill off methanol. Then, pure water was added to the residue in the same amount as that of the distilled-off methanol. This dispersion was thoroughly dried under reduced pressure at 80° C. The obtained silica particles were heated at 400° C. for 10 minutes in a thermostat bath. The foregoing process was carried out 20 times. The obtained silica fine particles were subjected to cracking treatment using a pulverizer (manufactured by Hosokawa Micron Group).

Thereafter, 500 g of the silica particles was charged into a 1000 mL polytetrafluoroethylene inner cylinder-type stainless autoclave. The interior of the autoclave was purged with nitrogen gas. Then, while a stirring blade attached to the autoclave was rotated at 400 rpm, 0.5 g of HMDS (hexamethyldisilazane) and 0.1 g of water were nebulized in a two-fluid nozzle and uniformly sprayed onto the silica powder. After stirring for 30 minutes, the autoclave was sealed and heated at 200° C. for 2 hours. Subsequently, the pressure in the system was reduced under heating for deammoniation to obtain silica fine particles B1. The physical properties of the silica fine particles B1 are shown in Table 2.

Production Examples 2 to 5 of Silica Fine Particles B

Silica fine particles B2 to B5 were obtained in the same way as in the Production Example of the silica fine particles B1 except that the particle size of the untreated silica used was changed and the cracking treatment intensity was appropriately adjusted. The physical properties of the silica fine particles B2 to B5 are shown in Table 2.

TABLE 2

| | Number-average particle size of primary particles [nm] | True density [g/cm$^3$] |
|---|---|---|
| Silica fine particles B1 | 100 | 2.2 |
| Silica fine particles B2 | 150 | 2.2 |
| Silica fine particles B3 | 40 | 2.2 |
| Silica fine particles B4 | 200 | 2.2 |
| Silica fine particles B5 | 50 | 2.2 |
| Silica fine particles B6 | 35 | 2.2 |
| Silica fine particles B7 | 250 | 2.2 |

Production Example of Magnetic Toner 1

The magnetic toner particles were subjected to external addition and mixing treatment using the apparatus illustrated in FIG. 3.

The apparatus illustrated in FIG. 3 was configured such that: the diameter of the inner periphery of the main casing 31 was 130 mm; and the volume of the treatment space 39 was $2.0\times10^{-3}$ m$^3$. In the apparatus used, the rated power of the driving member 38 was 5.5 kW, and the stirring members 33 were shaped as illustrated in FIG. 4. In addition, the width d of the overlap between the stirring members 33*a* and the stirring members 33*b* in FIG. 4 was set to 0.25 D with respect to the maximum width D of the stirring members 33, and the clearance between the stirring members 33 and the inner periphery of the main casing 31 was set to 3.0 mm.

100 parts by mass of the magnetic toner particles and 0.3 parts by mass of the silica fine particles B1 were introduced into the thus-configured apparatus illustrated in FIG. 3. After the introduction of the magnetic toner particles and the silica fine particles B1, premixing was carried out in order to uniformly mix the magnetic toner particles and the silica fine particles B1. Conditions for this premixing involved a power of the driving member 38 set to 0.10 W/g (rotational speed of the driving member 38: 150 rpm) and a treatment time set to 1 minute. After the completion of the premixing, the external addition and mixing treatment was performed. Conditions for the external addition and mixing treatment involved: adjusting the peripheral speed of the stirring members 33 at the outermost end portions thereof so as to set the power of the driving member 38 to the constant value of 0.30 W/g (rotational speed of the driving member 38: 1300 rpm); and a treatment time set to 5 minutes.

Thereafter, 0.90 parts by mass of the silica fine particles A1 were further added thereto, and premixing was carried out in order to uniformly mix the silica fine particles A1. Conditions for this premixing involved a power of the driving member 38 set to 0.10 W/g (rotational speed of the driving member 38: 150 rpm) and a treatment time set to 1 minute. After the completion of the premixing, the external addition and mixing treatment was performed. Conditions for the external addition and mixing treatment involved: adjusting the peripheral speed of the stirring members 33 at the outermost end portions thereof so as to set the power of the driving member 38 to the constant value of 0.30 W/g (rotational speed of the driving member 38: 1250 rpm); and a treatment time set to 5 minutes.

After the external addition and mixing treatment, coarse particles, etc. were removed using a circular vibrating screen equipped with a screen having a diameter of 500 mm and an aperture of 75 μm to obtain toner 1. The toner 1 was magnifying-observed under a scanning electron microscope to measure the abundance ratio of secondary particles to primary particles of the silica fine particles B on the surface of the toner particles. As a result, the abundance ratio was 10% by number. The external addition conditions for the toner 1 are shown in Table 3. Its physical properties are shown in Table 4.

Production Examples of Magnetic Toners 2 to 27 and Comparative Magnetic Toners 1 to 10

Magnetic toners 2 to 27 and comparative magnetic toners 1 to 10 were produced in the same way as in the Production Example of the magnetic toner 1 except that the type and the number of parts of the external additive added, the magnetic toner particles, the external addition apparatus and the external addition conditions were changed to those shown in Tables 3-1 and 3-2. The external addition conditions for the obtained magnetic toners 2 to 27 and the comparative magnetic toners 1 to 10 are shown in Tables 3-1 and 3-2. The physical properties of the obtained magnetic toners 2 to 27 and the comparative magnetic toners 1 to 10 are shown in Table 4.

In the case of using a Henschel mixer as the external addition apparatus, the Henschel mixer used was FM10C (Nippon Coke & Engineering. Co., Ltd. (formerly Mitsui Miike Machinery Co., Ltd.)). In some of these Production Examples, the premixing step was not performed.

TABLE 3-1

| Magnetic toner | Magnetic toner particles | External addition apparatus for first stage | Premixing conditions for first stage | External addition conditions for first stage: Type of silica fine particles (added in amount [part by mass]) | External addition conditions for first stage: First-stage external addition conditions | External addition apparatus for second stage | Premixing conditions for second stage | External addition conditions for second stage: Type of silica fine particles (added in amount [part by mass]) | External addition conditions for second stage: Second-stage external addition conditions |
|---|---|---|---|---|---|---|---|---|---|
| 1 | 1 | FIG. 4 | 0.10 W/g (150 rpm) · 1 min | B1 (0.30) | 0.30 W/g (1200 rpm) · 5 min | FIG. 4 | 0.10 W/g (150 rpm) · 1 min | A1 (0.90) | 0.30 W/g (1200 rpm) · 5 min |
| 2 | 1 | HM | 500 rpm · 1 min | B1 (0.30) | 4000 rpm · 6 min | FIG. 4 | 0.10 W/g (150 rpm) · 1 min | A1 (0.90) | 0.30 W/g (1200 rpm) · 5 min |
| 3 | 1 | HM | 500 rpm · 1 min | B1 (0.30) | 4000 rpm · 6 min | FIG. 4 | 0.10 W/g (150 rpm) · 1 min | A1 (0.90) | 0.30 W/g (1200 rpm) · 4 min |
| 4 | 1 | HM | 500 rpm · 1 min | B1 (0.30) | 4000 rpm · 6 min | FIG. 4 | 0.10 W/g (150 rpm) · 1 min | A1 (0.90) | 0.30 W/g (1200 rpm) · 3 min |
| 5 | 1 | FIG. 4 | 0.10 W/g (150 rpm) · 1 min | B1 (0.30) | 0.30 W/g (1200 rpm) · 5 min | FIG. 4 | 0.10 W/g (150 rpm) · 1 min | A1 (0.70) | 0.30 W/g (1200 rpm) · 10 min |
| 6 | 1 | FIG. 4 | 0.10 W/g (150 rpm) · 1 min | B1 (0.30) | 0.30 W/g (1200 rpm) · 5 min | FIG. 4 | 0.10 W/g (150 rpm) · 1 min | A1 (0.60) | 0.30 W/g (1200 rpm) · 10 min |
| 7 | 1 | HM | 500 rpm · 1 min | B1 (0.10) | 4000 rpm · 6 min | FIG. 4 | 0.10 W/g (150 rpm) · 1 min | A1 (0.90) | 0.30 W/g (1200 rpm) · 5 min |
| 8 | 1 | HM | 500 rpm · 1 min | B1 (0.50) | 4000 rpm · 6 min | FIG. 4 | 0.10 W/g (150 rpm) · 1 min | A1 (0.90) | 0.30 W/g (1200 rpm) · 5 min |
| 9 | 1 | HM | 500 rpm · 1 min | B1 (0.05) | 4000 rpm · 6 min | FIG. 4 | 0.10 W/g (150 rpm) · 1 min | A1 (0.90) | 0.30 W/g (1200 rpm) · 5 min |
| 10 | 1 | HM | 500 rpm · 1 min | B1 (0.60) | 4000 rpm · 6 min | FIG. 4 | 0.10 W/g (150 rpm) · 1 min | A1 (0.90) | 0.30 W/g (1200 rpm) · 5 min |
| 11 | 1 | HM | 500 rpm · 1 min | B1 (0.30) | 4000 rpm · 6 min | FIG. 4 | 0.10 W/g (150 rpm) · 1 min | A1 (0.50) | 0.30 W/g (1200 rpm) · 5 min |
| 12 | 1 | HM | 500 rpm · 1 min | B1 (0.30) | 4000 rpm · 6 min | FIG. 4 | 0.10 W/g (150 rpm) · 1 min | A1 (1.50) | 0.30 W/g (1200 rpm) · 5 min |
| 13 | 1 | HM | 500 rpm · 1 min | B1 (0.30) | 4000 rpm · 6 min | FIG. 4 | 0.10 W/g (150 rpm) · 1 min | A1 (0.40) | 0.30 W/g (1200 rpm) · 5 min |
| 14 | 1 | HM | 500 rpm · 1 min | B1 (0.40) | 4000 rpm · 6 min | FIG. 4 | 0.10 W/g (150 rpm) · 1 min | A1 (1.55) | 0.30 W/g (1200 rpm) · 5 min |
| 15 | 1 | HM | 500 rpm · 1 min | B1 (0.10) | 4000 rpm · 6 min | FIG. 4 | 0.10 W/g (150 rpm) · 1 min | A1 (0.50) | 0.30 W/g (1200 rpm) · 5 min |
| 16 | 1 | HM | 500 rpm · 1 min | B1 (0.50) | 4000 rpm · 6 min | FIG. 4 | 0.10 W/g (150 rpm) · 1 min | A1 (1.50) | 0.30 W/g (1200 rpm) · 5 min |
| 17 | 1 | HM | 500 rpm · 1 min | B1 (0.05) | 4000 rpm · 6 min | FIG. 4 | 0.10 W/g (150 rpm) · 1 min | A1 (0.40) | 0.30 W/g (1200 rpm) · 5 min |
| 18 | 1 | HM | 500 rpm · 1 min | B1 (0.30) | 4000 rpm · 6 min | FIG. 4 | 0.10 W/g (150 rpm) · 1 min | A1 (0.90) | 0.30 W/g (1200 rpm) · 4 min |
| 19 | 1 | HM | None | B1 (0.30) | 4000 rpm · 6 min | FIG. 4 | None | A1 (0.90) | 0.30 W/g (1200 rpm) · 4 min |
| 20 | 1 | HM | 500 rpm · 1 min | B1 (0.55) | 4000 rpm · 6 min | FIG. 4 | 0.10 W/g (150 rpm) · 1 min | A1 (1.55) | 0.30 W/g (1200 rpm) · 5 min |
| 21 | 1 | HM | 500 rpm · 1 min | B1 (0.05) | 4000 rpm · 6 min | FIG. 4 | 0.10 W/g (150 rpm) · 1 min | A1 (0.40) | 0.30 W/g (1200 rpm) · 4 min |
| 22 | 1 | FIG. 4 | 0.10 W/g (150 rpm) · 1 min | B2 (0.30) | 0.50 W/g (2000 rpm) · 10 min | FIG. 4 | 0.10 W/g (150 rpm) · 1 min | A1 (0.90) | 0.30 W/g (1200 rpm) · 5 min |
| 23 | 1 | HM | 500 rpm · 1 min | B2 (0.30) | 4000 rpm · 6 min | FIG. 4 | 0.10 W/g (150 rpm) · 1 min | A1 (0.90) | 0.30 W/g (1200 rpm) · 3 min |
| 24 | 1 | HM | 500 rpm · 1 min | B3 (0.30) | 4000 rpm · 6 min | FIG. 4 | 0.10 W/g (150 rpm) · 1 min | A1 (0.90) | 0.30 W/g (1200 rpm) · 5 min |
| 25 | 1 | HM | 500 rpm · 1 min | B4 (0.30) | 4000 rpm · 6 min | FIG. 4 | 0.10 W/g (150 rpm) · 1 min | A1 (0.90) | 0.30 W/g (1200 rpm) · 5 min |
| 26 | 1 | HM | 500 rpm · 1 min | B1 (0.30) | 4000 rpm · 6 min | FIG. 4 | 0.10 W/g (150 rpm) · 1 min | A2 (0.60) | 0.30 W/g (1200 rpm) · 5 min |
| 27 | 1 | HM | 500 rpm · 1 min | B1 (0.50) | 4000 rpm · 6 min | FIG. 4 | 0.10 W/g (150 rpm) · 1 min | A3 (1.20) | 0.30 W/g (1200 rpm) · 5 min |

External addition apparatus: "FIG. 4" means the "apparatus illustrated in FIG. 4", and "HM" represents a "Henschel mixer".

TABLE 3-2

| Comparative magnetic toner | Magnetic toner particles | External addition apparatus for first stage | Premixing conditions for first stage | External addition conditions for first stage: Type of silica fine particles (added in amount [part by mass]) | External addition conditions for first stage: First-stage external addition conditions | External addition apparatus for second stage | Premixing conditions for second stage | External addition conditions for second stage: Type of silica fine particles (added in amount [part by mass]) | External addition conditions for second stage: Second-stage external addition conditions |
|---|---|---|---|---|---|---|---|---|---|
| 1 | 1 | HM | 500 rpm · 1 min | B1 (0.05) | 4000 rpm · 6 min | HM | 500 rpm · 1 min | A1 (0.40) | 4000 rpm · 6 min |
| 2 | 1 | HM | 500 rpm · 1 min | B1 (0.55) | 4000 rpm · 6 min | FIG. 4 | 0.10 W/g (150 rpm) · 1 min | A1 (1.60) | 0.50 W/g (2000 rpm) · 5 min |
| 3 | 1 | FIG. 4 | 0.10 W/g (150 rpm) · 1 min | B2 (0.30) | 0.50 W/g (2000 rpm) · 15 min | FIG. 4 | 0.10 W/g (150 rpm) · 1 min | A1 (0.90) | 0.30 W/g (1200 rpm) · 5 min |
| 4 | 1 | None | None | None | None | FIG. 4 | 0.10 W/g (150 rpm) · 1 min | B2 (0.30) A1 (0.90) | 0.30 W/g (1200 rpm) · 3 min |
| 5 | 1 | HM | 500 rpm · 1 min | B5 (0.50) | 4000 rpm · 6 min | FIG. 4 | 0.10 W/g (150 rpm) · 1 min | A1 (0.70) | 0.30 W/g (1200 rpm) · 5 min |
| 6 | 1 | HM | 500 rpm · 1 min | B6 (0.50) | 4000 rpm · 6 min | FIG. 4 | 0.10 W/g (150 rpm) · 1 min | A1 (0.70) | 0.30 W/g (1200 rpm) · 5 min |
| 7 | 1 | HM | 500 rpm · 1 min | B7 (0.50) | 4000 rpm · 6 min | FIG. 4 | 0.10 W/g (150 rpm) · 1 min | A1 (0.70) | 0.30 W/g (1200 rpm) · 5 min |
| 8 | 1 | HM | 500 rpm · 1 min | A5 (0.50) | 4000 rpm · 6 min | FIG. 4 | 0.10 W/g (150 rpm) · 1 min | A4 (1.40) | 0.30 W/g (1200 rpm) · 5 min |
| 9 | 1 | None | None | None | None | FIG. 4 | 0.10 W/g (150 rpm) · 1 min | A3 (1.20) | 0.30 W/g (1200 rpm) · 5 min |
| 10 | 1 | HM | 500 rpm · 1 min | B1 (2.00) | 4000 rpm · 6 min | FIG. 4 | None | None | 0.30 W/g (1200 rpm) · 5 min |

External addition apparatus: "FIG. 4" means the "apparatus illustrated in FIG. 4", and "HM" represents a "Henschel mixer".

TABLE 4

| Magnetic toner | Magnetic toner particles | D4 (μm) | Average circularity | Coverage ratio X1 (% by area) | Diffusion index (X1/X2) | Lower limit of diffusion index (−0.0042 × X1 + 0.62) | Abundance ratio of secondary particles of silica fine particles B (% by number) | Isolation rate of silica fine particles (%) | Total energy mJ/(g/ml) |
|---|---|---|---|---|---|---|---|---|---|
| 1 | 1 | 8.0 | 0.975 | 62 | 0.443 | 0.360 | 10 | 5 | 280 |
| 2 | 1 | 8.0 | 0.975 | 60 | 0.429 | 0.368 | 10 | 5 | 300 |
| 3 | 1 | 8.0 | 0.975 | 60 | 0.429 | 0.368 | 35 | 30 | 310 |
| 4 | 1 | 8.0 | 0.975 | 60 | 0.429 | 0.368 | 38 | 35 | 310 |
| 5 | 1 | 8.0 | 0.975 | 56 | 0.510 | 0.385 | 8 | 3 | 355 |
| 6 | 1 | 8.0 | 0.975 | 52 | 0.549 | 0.402 | 8 | 3 | 360 |
| 7 | 1 | 8.0 | 0.975 | 59 | 0.431 | 0.372 | 10 | 5 | 300 |
| 8 | 1 | 8.0 | 0.975 | 65 | 0.455 | 0.347 | 10 | 8 | 290 |
| 9 | 1 | 8.0 | 0.975 | 59 | 0.434 | 0.372 | 10 | 5 | 305 |
| 10 | 1 | 8.0 | 0.975 | 65 | 0.450 | 0.347 | 10 | 8 | 295 |
| 11 | 1 | 8.0 | 0.975 | 47 | 0.590 | 0.423 | 10 | 5 | 340 |
| 12 | 1 | 8.0 | 0.975 | 73 | 0.317 | 0.313 | 10 | 8 | 290 |
| 13 | 1 | 8.0 | 0.975 | 43 | 0.665 | 0.439 | 10 | 5 | 350 |
| 14 | 1 | 8.0 | 0.975 | 74 | 0.310 | 0.309 | 10 | 8 | 290 |
| 15 | 1 | 8.0 | 0.975 | 50 | 0.652 | 0.410 | 10 | 5 | 350 |
| 26 | 1 | 8.0 | 0.975 | 74 | 0.318 | 0.309 | 10 | 8 | 290 |
| 17 | 1 | 8.0 | 0.975 | 42 | 0.690 | 0.444 | 10 | 5 | 360 |
| 18 | 1 | 8.0 | 0.975 | 55 | 0.393 | 0.389 | 10 | 8 | 330 |
| 19 | 1 | 8.0 | 0.975 | 52 | 0.372 | 0.402 | 10 | 8 | 335 |
| 20 | 1 | 8.0 | 0.975 | 75 | 0.311 | 0.305 | 10 | 10 | 290 |
| 21 | 1 | 8.0 | 0.975 | 40 | 0.657 | 0.452 | 10 | 5 | 280 |
| 22 | 1 | 8.0 | 0.975 | 60 | 0.434 | 0.368 | 5 | 3 | 315 |
| 23 | 1 | 8.0 | 0.975 | 60 | 0.434 | 0.368 | 40 | 35 | 310 |
| 24 | 1 | 8.0 | 0.975 | 65 | 0.443 | 0.347 | 10 | 3 | 290 |
| 25 | 1 | 8.0 | 0.975 | 60 | 0.436 | 0.368 | 7 | 8 | 290 |

TABLE 4-continued

| Magnetic toner | Magnetic toner particles | D4 (μm) | Average circularity | Coverage ratio X1 (% by area) | Diffusion index (X1/X2) | Lower limit of diffusion index (−0.0042 × X1 + 0.62) | Abundance ratio of secondary particles of silica fine particles B (% by number) | Isolation rate of silica fine particles (%) | Total energy mJ/(g/ml) |
|---|---|---|---|---|---|---|---|---|---|
| 26 | 1 | 8.0 | 0.975 | 60 | 0.324 | 0.368 | 10 | 5 | 300 |
| 27 | 1 | 8.0 | 0.975 | 50 | 0.512 | 0.410 | 10 | 5 | 360 |
| Comparative 1 | 1 | 8.0 | 0.975 | 35 | 0.575 | 0.473 | 10 | 5 | 370 |
| Comparative 2 | 1 | 8.0 | 0.975 | 80 | 0.321 | 0.284 | 10 | 10 | 290 |
| Comparative 3 | 1 | 8.0 | 0.975 | 60 | 0.434 | 0.368 | 3 | 3 | 315 |
| Comparative 4 | 1 | 8.0 | 0.975 | 60 | 0.416 | 0.368 | 45 | 35 | 310 |
| Comparative 5 | 1 | 8.0 | 0.975 | 60 | 0.473 | 0.368 | 10 | 5 | 290 |
| Comparative 6 | 1 | 8.0 | 0.975 | 60 | 0.532 | 0.368 | 10 | 5 | 300 |
| Comparative 7 | 1 | 8.0 | 0.975 | 60 | 0.532 | 0.368 | 10 | 5 | 360 |
| Comparative 8 | 1 | 8.0 | 0.975 | 60 | 0.654 | 0.368 | 10 | 5 | 280 |
| Comparative 9 | 1 | 8.0 | 0.975 | 45 | 0.249 | 0.431 | — | 5 | 400 |
| Comparative 10 | 1 | 8.0 | 0.975 | 10 | 0.333 | 0.578 | 10 | 5 | 280 |

Example 1

The magnetic toner 1 was used in evaluation described below. The evaluation results are shown in Table 5.

(Image Forming Apparatus)

A printer LBP3100 manufactured by Canon Inc. was adapted to use in image output evaluation. Specifically, the printer was adapted such that the developer bearing member was in contact with the electrostatic latent image-bearing member as illustrated in FIGS. 1A and 1B. The contact pressure was adjusted such that the contact area between the developer bearing member and the electrostatic latent image-bearing member was 1.0 mm. This adaptation creates very strict evaluation conditions as to ghosts, because a toner-supplying member is absent; thus toner on the developer bearing member cannot be scraped off. Also, this adaptation creates strict evaluation conditions as to fogs on a drum after development of a black image, because the toner-supplying member is absent.

50 g of the magnetic toner 1 was charged into the developing apparatus thus adapted, and the developing apparatus was prepared using the developer bearing member 51. The prepared developing apparatus was used to output 1500 images in an environment of low temperature and low humidity (temperature of 15° C. and relative humidity of 10% RH). The image output test was conducted in a lateral line intermittent mode with 1% coverage rate for the images.

As a result, favorable images were successfully obtained without ghosting in the environment of low temperature and low humidity. The evaluation results are shown in Table 5.

Each evaluation method conducted in Examples of the present invention and Comparative Examples as well as the criteria therefor will be described below.

<Image Density>

For the image density, a solid image was formed, and the density of this solid image was measured using a Macbeth reflection densitometer (manufactured by Macbeth Corporation). The solid image reflecting densities in initial use (Evaluation 1) and after printing of 4000 sheets (Evaluation 2) were evaluated according to the following criteria:

A: Excellent (1.46 or higher)

B: Good (1.41 or higher and 1.45 or lower)

C: Fair (1.36 or higher and 1.40 or lower)

D: Poor (1.35 or lower)

<Ghost>

Several 10 mm×10 mm solid images were formed on the front half of transfer paper, and 2-dot 3-space halftone images were formed on the posterior half of the transfer paper. The degree of a trace of the solid images on the halftone images was visually determined.

A: No ghosting

B: Very slight ghosting

C: Slight ghosting

D: Marked ghosting

<Fog on Drum after Development of Black Image>

The fogs were assayed using REFLECTMETER MODEL TC-6DS manufactured by Tokyo Denshoku Co., Ltd. The filter used was a green filter. A piece of Mylar tape was taped onto the drum before transfer of a solid black image, and the fogs on the drum after development of a black image were calculated by subtracting the Macbeth concentration of the Mylar tape on unused paper from the reflectivity on the Mylar-taped paper.

Fog (%)=Reflectivity (%)on normal paper−Reflectivity (%)of the image-free portion of the sample A: 5% or lower B: 6% or more and 10% or lower C: 11% or more and 21% or lower D: 21% or more

Examples 2 to 27 and Comparative Examples 1 to 10

The toner evaluation was conducted under the same conditions as in Example 1 using the magnetic toners 2 to 27 and the comparative magnetic toners 1 to 10 as magnetic toner samples. The evaluation results are shown in Table 5.

TABLE 5

| | | Image density | | Ghost | | Fog on Dr after development of black image | |
|---|---|---|---|---|---|---|---|
| | | Initial | After output of 1500 images | Initial | After output of 1500 images | Initial (%) | After output of 1500 images (%) |
| Example 1 | Magnetic toner 1 | A(1.52) | A(1.51) | A | A | 1 | 2 |
| Example 2 | Magnetic toner 2 | A(1.51) | A(1.48) | A | A | 2 | 3 |
| Example 3 | Magnetic toner 3 | A(1.50) | B(1.45) | A | B | 3 | 5 |
| Example 4 | Magnetic toner 4 | B(1.45) | B(1.42) | A | B | 4 | 7 |
| Example 5 | Magnetic toner 5 | B(1.44) | B(1.41) | B | B | 7 | 10 |
| Example 6 | Magnetic toner 6 | B(1.45) | B(1.43) | B | C | 10 | 14 |
| Example 7 | Magnetic toner 7 | A(1.52) | C(1.38) | A | C | 6 | 15 |
| Example 8 | Magnetic toner 8 | B(1.44) | B(1.42) | B | B | 11 | 14 |
| Example 9 | Magnetic toner 9 | A(1.50) | C(1.37) | B | C | 8 | 17 |
| Example 10 | Magnetic toner 10 | B(1.44) | B(1.41) | B | B | 14 | 16 |
| Example 11 | Magnetic toner 11 | A(1.52) | C(1.38) | B | C | 6 | 17 |
| Example 12 | Magnetic toner 12 | B(1.44) | B(1.41) | B | C | 6 | 17 |
| Example 13 | Magnetic toner 13 | B(1.44) | C(1.37) | B | C | 9 | 18 |
| Example 14 | Magnetic toner 14 | B(1.44) | B(1.41) | C | C | 14 | 15 |
| Example 15 | Magnetic toner 15 | B(1.44) | C(1.36) | B | C | 8 | 19 |
| Example 16 | Magnetic toner 16 | C(1.38) | C(1.36) | C | C | 15 | 17 |
| Example 17 | Magnetic toner 17 | C(1.38) | C(1.36) | C | C | 10 | 20 |
| Example 18 | Magnetic toner 18 | C(1.40) | C(1.36) | C | C | 15 | 18 |
| Example 19 | Magnetic toner 19 | C(1.39) | C(1.37) | C | C | 16 | 20 |
| Example 20 | Magnetic toner 20 | B(1.41) | C(1.36) | C | C | 16 | 17 |
| Example 21 | Magnetic toner 21 | C(1.40) | C(1.36) | C | C | 17 | 20 |
| Example 22 | Magnetic toner 22 | B(1.45) | B(1.42) | B | C | 4 | 14 |
| Example 23 | Magnetic toner 23 | B(1.44) | C(1.36) | C | C | 15 | 18 |
| Example 24 | Magnetic toner 24 | A(1.52) | C(1.38) | A | C | 5 | 17 |
| Example 25 | Magnetic toner 25 | B(1.44) | C(1.37) | B | C | 8 | 17 |
| Example 26 | Magnetic toner 26 | A(1.52) | C(1.38) | A | C | 8 | 19 |
| Example 27 | Magnetic toner 27 | C(1.38) | C(1.36) | C | C | 15 | 20 |
| Comparative Example 1 | Comparative magnetic toner 1 | C(1.40) | D(1.33) | C | D | 14 | 27 |
| Comparative Example 2 | Comparative magnetic toner 2 | C(1.38) | D(1.34) | C | C | 19 | 22 |
| Comparative Example 3 | Comparative magnetic toner 3 | C(1.40) | D(1.34) | B | D | 9 | 17 |
| Comparative Example 4 | Comparative magnetic toner 4 | B(1.44) | D(1.31) | C | D | 18 | 22 |
| Comparative Example 5 | Comparative magnetic toner 5 | B(1.45) | D(1.30) | B | D | 9 | 21 |
| Comparative Example 6 | Comparative magnetic toner 6 | C(1.38) | C(1.38) | C | C | 10 | 22 |
| Comparative Example 7 | Comparative magnetic toner 7 | D(1.33) | D(1.33) | D | D | 22 | 32 |
| Comparative Example 8 | Comparative magnetic toner 8 | C(1.38) | D(1.30) | C | D | 18 | 26 |
| Comparative Example 9 | Comparative magnetic toner 9 | C(1.36) | D(1.25) | C | D | 19 | 28 |
| Comparative Example 10 | Comparative magnetic toner 10 | D(1.10) | D(1.05) | D | D | 30 | 38 |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-269544, filed Dec. 26, 2013, which is hereby incorporated by reference herein in its entirety.

What is claimed is:

1. Magnetic toner comprising magnetic toner particles each containing a binder resin, a magnetic material and a releasing agent, and silica fine particles present on the surfaces of the magnetic toner particles, wherein the silica fine particles comprise silica fine particles A and silica fine particles B, the silica fine particles A have a number-average particle size (D1) of 5 nm or larger and 20 nm or smaller as primary particles, the silica fine particles B are produced by a sol-gel method, and have a number-average particle size (D1) of 40 nm or larger and 200 nm or smaller as primary particles, an abundance ratio of secondary particles of the silica fine particles B is 5% by number or more and 40% by number or less, and a coverage ratio X1 of the surface of the magnetic toner particles with the silica fine particles determined by electron spectroscopy for chemical analysis (ESCA) is 40.0% by area or more and 75.0% by area or less.

2. The magnetic toner according to claim 1, wherein when a theoretical coverage ratio of the surface of the magnetic toner with the silica fine particles is defined as X2, a diffusion index represented by the following Expression 1 satisfies the following Expression 2:

$$\text{Diffusion index}=X1/X2 \quad \text{(Expression 1)}$$

$$\text{Diffusion index}\geq -0.0042\times X1+0.62. \quad \text{(Expression 2)}$$

3. The magnetic toner according to claim 1, wherein with respect to 100 parts by mass of the magnetic toner particles, a total amount of the silica fine particles is 0.6 parts by mass or larger and 2.0 parts by mass or smaller, an amount of the silica fine particles A is 0.5 parts by mass or larger and 1.5 parts by mass or smaller, and an amount of the silica fine particles B is 0.1 parts by mass or larger and 0.5 parts by mass or smaller.

4. The magnetic toner according to claim 1, wherein the magnetic toner has a total energy of 280 mJ/(g/mL) or higher and 355 mJ/(g/mL) or lower.

* * * * *